US010532558B2

(12) United States Patent
Ohnishi et al.

(10) Patent No.: US 10,532,558 B2
(45) Date of Patent: Jan. 14, 2020

(54) INK JET PRINTING METHOD AND INK JET PRINTING APPARATUS

(71) Applicant: CANON KABUSHIKI KAISHA, Tokyo (JP)

(72) Inventors: Toru Ohnishi, Yokohama (JP); Yoichi Takada, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/038,245

(22) Filed: Jul. 18, 2018

(65) Prior Publication Data

US 2019/0023002 A1 Jan. 24, 2019

(30) Foreign Application Priority Data

Jul. 18, 2017 (JP) ..... 2017-139516

(51) Int. Cl.

| | |
|---|---|
| ***B41J 2/045*** | (2006.01) |
| ***B41J 2/05*** | (2006.01) |
| ***B41J 2/475*** | (2006.01) |
| ***B41J 2/01*** | (2006.01) |

(52) U.S. Cl.

CPC ..... *B41J 2/04501* (2013.01); *B41J 2/05* (2013.01); *B41J 2/4753* (2013.01); *B41J 2002/012* (2013.01)

(58) Field of Classification Search

CPC ..... B41J 2/04501; B41J 2/05; B41J 2/0057; B41J 2002/012; B41J 2/4753

USPC ..... 347/103

See application file for complete search history.

(56) References Cited

U.S. PATENT DOCUMENTS

| | | | |
|---|---|---|---|
| 5,100,468 | A | 3/1992 | Yuasa et al. |
| 6,848,781 | B2 | 2/2005 | Ogino et al. |
| 6,929,362 | B2 | 8/2005 | Takada et al. |
| 6,932,465 | B2 | 8/2005 | Nito et al. |
| 6,935,732 | B2 | 8/2005 | Takada et al. |

(Continued)

FOREIGN PATENT DOCUMENTS

| | | |
|---|---|---|
| EP | 2 105 318 A1 | 9/2009 |
| JP | 2011-126101 A | 6/2011 |

OTHER PUBLICATIONS

Dec. 13, 2018 extended European Search Report in European Patent Appln. No. 18183752.7.

*Primary Examiner* — Stephen D Meier
*Assistant Examiner* — Alexander D Shenderov
(74) *Attorney, Agent, or Firm* — Venable LLP

(57) ABSTRACT

There is provided an ink jet printing method including: an image forming process of applying ink onto an image forming surface of a transfer body to form a first intermediate image; an auxiliary liquid applying process of applying an auxiliary liquid containing a thermoplastic resin onto the first intermediate image on the transfer body to form a second intermediate image; and a transferring process of contacting the second intermediate image on the transfer body with a printing medium and separating the second intermediate image from the transfer body while maintaining a contact state with the printing medium to transfer the second intermediate image to the printing medium, wherein in the auxiliary liquid applying process, an area difference between an area of a first intermediate image and an area of an auxiliary liquid application area in the image forming surface is adjusted.

20 Claims, 9 Drawing Sheets

(56) References Cited

U.S. PATENT DOCUMENTS

| | | | | |
|---|---|---|---|---|
| 7,291,361 | B2 | 11/2007 | Ogino et al. | |
| 7,354,145 | B2 | 4/2008 | Nito et al. | |
| 7,377,631 | B2 | 5/2008 | Takada et al. | |
| 8,500,269 | B2 | 8/2013 | Morita | |
| 9,090,789 | B2 | 7/2015 | Hakamada et al. | |
| 9,566,781 | B2 | 2/2017 | Takeuchi et al. | |
| 2005/0110855 | A1 | 5/2005 | Taniuchi et al. | |
| 2011/0141188 | A1* | 6/2011 | Morita | B41J 2/0057 347/20 |
| 2016/0303847 | A1 | 10/2016 | Soma et al. | |
| 2017/0217217 | A1 | 8/2017 | Miyakoshi et al. | |
| 2017/0282533 | A1* | 10/2017 | Sakurada | B41J 2/0057 |

* cited by examiner

INK JET PRINTING METHOD AND INK JET PRINTING APPARATUS

BACKGROUND OF THE INVENTION

Field of the Invention

The present invention relates to an ink jet printing method and an ink jet printing apparatus.

Description of the Related Art

In an ink jet printing method, an image is formed by directly or indirectly applying a liquid composition (ink) containing a coloring material onto a printing medium such as paper. In this case, curls and cockling may occur due to excessive absorption of a liquid component in the ink by the printing medium.

Therefore, there is a method of forming an image on a transfer body, removing a liquid component contained in the image on the transfer body by thermal energy or the like, and then transferring the image onto a printing medium such as paper.

However, in such a transfer type ink jet printing method, at the time of continuously printing an image, surface properties of the transfer body are changed by influences of pressure repeatedly applied to the transfer body and the like, such that image quality is deteriorated by image disturbance and transfer failure. For this reason, there is a need to regularly replace or regenerate the transfer body, and it is preferable to suitably determine a replacement or regeneration time. The reason is that when the replacement or regeneration time is excessively late, there is a high possibility that an image formed product with inferior image quality is produced. On the contrary, when the replacement or regeneration time is too early, the transfer body will be unnecessarily replaced, etc., which is disadvantageous in view of productivity or cost.

U.S. Patent Application Publication No. 2011/0141188 discloses a method of using auxiliary liquid for improving transferability of an image to control a thickness of the auxiliary liquid so that a thickness of ink forming the image on a transfer body and the thickness of the auxiliary liquid are averaged.

In a case of forming a large amount of images by repeatedly using a transfer body in an image forming apparatus using an auxiliary liquid for transferring, there is a need to efficiently use the auxiliary liquid to decrease a consumption amount of the auxiliary liquid without deteriorating transferability in order to suppress a running cost of the apparatus.

On the other hand, according to the study of the present inventors, it was appreciated that transfer failure may occur depending on the kind of paper in the method disclosed in U.S. Patent Application Publication No. 2011/0141188.

Therefore, an object of the present invention is to provide an ink jet printing method and an ink jet printing apparatus capable of simultaneously suppressing transfer failure and a running cost.

SUMMARY OF THE INVENTION

An ink jet printing method includes: an image forming process of applying ink onto an image forming surface of a transfer body to form a first intermediate image; an auxiliary liquid applying process of applying an auxiliary liquid containing a thermoplastic resin onto the first intermediate image on the transfer body to form a second intermediate image; and a transferring process of contacting the second intermediate image on the transfer body with a printing medium and separating the second intermediate image from the transfer body while maintaining a contact state with the printing medium to transfer the second intermediate image to the printing medium. In the image forming surface, a region including the first intermediate image on the image forming surface and being wider than the first intermediate image is set as an auxiliary liquid application region. In the auxiliary liquid applying process, the auxiliary liquid is applied onto the auxiliary liquid application region. The auxiliary liquid applying process includes an auxiliary liquid amount controlling process of performing a control of an auxiliary liquid application amount so that an area difference between an area of the first intermediate image and an area of the auxiliary liquid application region in the image forming surface in the case in which the area of the first intermediate image is a second area larger than a first area is set to be smaller than that in the case in which the area of the first intermediate image is the first area.

Further features of the present invention will become apparent from the following description of exemplary embodiments with reference to the attached drawings.

DESCRIPTION OF THE EMBODIMENTS

The present inventors investigated a method of using an auxiliary liquid capable of simultaneously suppressing transfer failure and a running cost.

According to the investigation on suppression of transfer failure by the present inventors, it could be appreciated that in the method described in U.S. Patent Application Publication No. 2011/0141188, transfer failure may occur depending on the kind of paper. The present inventors estimated that the reason is that in the case of an ink image having a small area such as a dot shape, even if a thickness of a portion to which the auxiliary liquid is applied just above the ink image is increased, a contact area between the ink image and paper in a plane direction cannot be sufficiently obtained on paper having large unevenness.

Therefore, the present inventors obtained new knowledge that in the case of the ink image having a small area, transferability of the ink image can be improved by applying an auxiliary liquid in a region that includes the ink image but is wider than that of the ink image in the plane direction.

On the other hand, according to the investigation on the running cost of the apparatus, the present inventors obtained new knowledge that an amount of the auxiliary liquid applied to the ink image can be efficiently adjusted depending on an area of the ink image formed on an image forming surface of the transfer body, the kind of printing medium or both of them.

As an example of the ink jet printing apparatus according to the present exemplary embodiment, there is an ink jet printing apparatus ejecting an ink on a transfer body as an ink receiving medium to form an ink image (first intermediate image) and transferring an ink image after liquid removal from the ink image by a liquid removing apparatus to a printing medium. Further, in the present exemplary embodiment, for convenience, the above-mentioned ink jet printing apparatus is referred to as a transfer type ink jet printing apparatus.

An image forming unit forming the first intermediate image includes an ink applying device applying the ink onto the transfer body. The image forming unit may further include a reaction liquid applying device in addition to the ink applying device.

Further, a liquid removing device removing a liquid component from a second intermediate image may be provided.

The transfer type ink jet printing apparatus is described below.

(Transfer Type Ink Jet Printing Apparatus)

Figure 1:
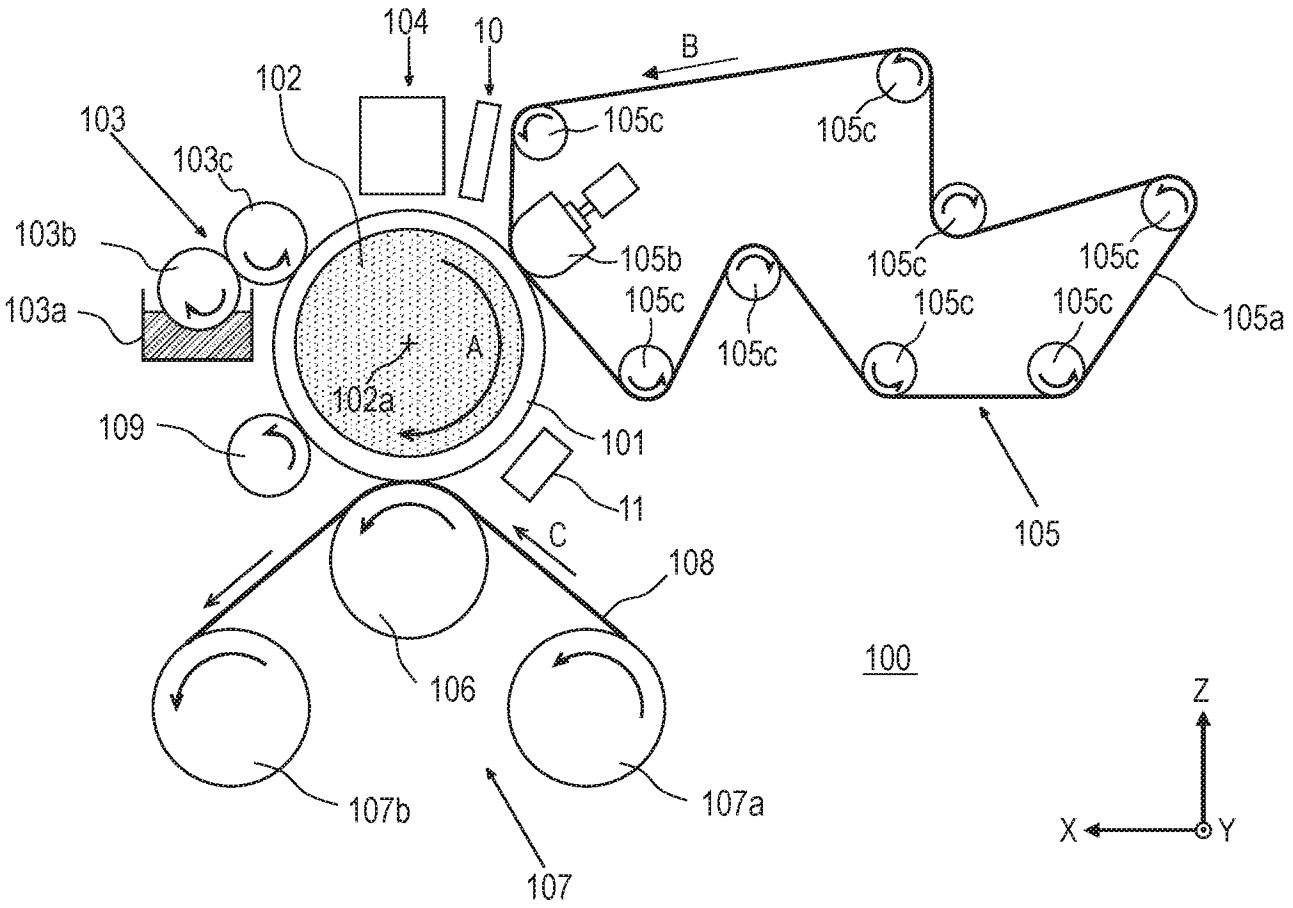
FIG. 1 is a schematic diagram illustrating an example of a configuration of a transfer type ink jet printing apparatus according to an exemplary embodiment of the present invention.

FIG. 1 is a schematic diagram illustrating an example of a configuration of a transfer type ink jet printing apparatus 100 according to the present exemplary embodiment. This printing apparatus is a sheet type ink jet printing apparatus transferring an ink image to a printing medium 108 through the transfer body 101 to manufacture a printing matter. In the present exemplary embodiment, an X direction, a Y direction and a Z direction refer to a width direction (full length direction), a depth direction and a height direction of the ink jet printing apparatus 100, respectively. The printing medium P is conveyed in the X direction.

The transfer type ink jet printing apparatus 100 according to the present exemplary embodiment includes the following members and devices as illustrated in FIG. 1:

- the transfer body 101 supported by a support member 102;
- a reaction liquid applying device 103 applying a reaction liquid containing a component increasing a viscosity of ink forming an ink image on the transfer body 101;
- an ink applying device 104 including an ink jet head applying the ink forming the ink image on the transfer body 101 applied with the reaction liquid to form the ink image corresponding to an image by the ink on the transfer body;
- an auxiliary liquid applying device 10 applying an auxiliary liquid assisting in transferring;
- a liquid removing device 105 removing a liquid component from the ink image on the transfer body; and
- a pressing member 106 for transferring the ink image on the transfer body from which the liquid component has been removed to the printing medium 108 such as paper.

Further, if necessary, the transfer type ink jet printing apparatus 100 may further include a transfer body cleaning member 109 cleaning a surface of the transfer body 101 after transferring. The transfer body 101, the reaction liquid applying device 103, the liquid removing device 105 and the transfer body cleaning member 109 have lengths corresponding to the used printing medium 108 in the Y direction, respectively. The ink jet head of the ink applying device 104 and an ink jet head of the auxiliary liquid applying device 10 also have lengths corresponding to the used printing medium 108 in the Y direction, respectively.

The transfer body 101 rotates based on a rotation shaft 102*a* of the support member 102 in an arrow A direction of FIG. 1. The transfer body 101 is moved by rotation of the support member 102. The reaction liquid and the ink are sequentially applied onto an image forming surface of the moved transfer body 101 by the reaction liquid applying device 103 and the ink applying device 104, such that the ink image is formed on the transfer body 101. Further, the auxiliary liquid is applied onto the ink image by the auxiliary liquid applying device 10. The ink image applied with the auxiliary liquid is moved up to a position at which the ink image comes in contact with a liquid absorbing member 105*a* of the liquid removing device 105 by movement of the transfer body 101. Further, a control of an application position and an application amount of the auxiliary liquid onto an image forming surface of an intermediate transfer body 101 is described below.

The transfer body 101 and the liquid removing device 105 move in sync with the rotation of the transfer body 101. The ink image formed on the transfer body 101 comes in contact with the moving liquid absorbing member 105*a* as described above. During the contact, the liquid absorbing member 105*a* removes the liquid component from the ink image applied with the auxiliary liquid on the transfer body. In this contact state, it is particularly preferable that the liquid absorbing member 105*a* is pressed against the transfer body 101 at a predetermined pressing force in order to allow the liquid absorbing member 105*a* to effectively function.

The removal of the liquid component can be expressed from a different point of view as concentrating the ink constituting the image formed on the transfer body. Concentrating the ink means that a proportion of the solid content contained in the ink, such as the coloring material and the resin, with respect to the liquid component contained in the ink increases owing to reduction in the liquid component.

In addition, the ink image after liquid removal from which the liquid component is removed is in a state in which the ink is concentrated as compared to the ink image before liquid removal to thereby be moved to a transfer part 111 coming in contact with the printing medium 108 conveyed by a printing medium conveyance device 107 by the transfer body 101. While the ink image after liquid removal comes in contact with the printing medium 108, the pressing member 106 presses the transfer body 101, such that the ink image is transferred onto the printing medium 108. The ink image after the transfer, transferred onto the printing medium 108 is the ink image before liquid removal and a reverse image of the ink image after liquid removal.

Further, in the present exemplary embodiment, since the image is formed by applying the ink after applying the reaction liquid onto the transfer body, the reaction liquid has not reacted with the ink but remains in a non-image region in which the image by the ink is not formed. In the present apparatus, the liquid absorbing member 105*a* comes in contact with not only the image but also an unreacted reaction liquid, such that a liquid component of the reaction liquid is also removed.

Furthermore, in the case in which the auxiliary liquid contains water, similarly to the reaction liquid, even when the auxiliary liquid applied to the non-image region in which the image by the ink is not formed contains a liquid component such as water, the liquid absorbing member 105*a* also removes the liquid component of the auxiliary liquid as well as the reaction liquid.

Therefore, although the above description expresses that the liquid component is removed from the image, the expression is not limited to removal of the liquid component only from the image, but means that the liquid component is removed at least from the image on the transfer body.

Further, the liquid component is not particularly limited so long as it does not have a certain shape, has fluidity, and has a substantially constant volume.

Examples of the liquid component can include water or an organic solvent, etc. contained in the ink, the reaction liquid or the auxiliary liquid.

Each configuration of a transfer type ink jet printing apparatus according to the present exemplary embodiment is described below.

<Transfer Body>

The transfer body 101 has a surface layer having an image forming surface. As a member of the surface layer, various materials such as resins and ceramics can be suitably used, but in view of durability, etc. a material having a high compressive elastic modulus is preferable. Specific examples thereof can include an acrylic resin, an acrylic silicone resin, a fluorine-containing resin, a condensate prepared by condensation of a hydrolyzable organic silicon compound and the like. In order to improve wettability of the reaction liquid, transferability, etc., surface treatment may be performed. Examples of the surface treatment can include flame treatment, corona treatment, plasma treatment, polishing treatment, roughening treatment, active energy ray-irradiation treatment, ozone treatment, surfactant treatment, silane coupling treatment and the like. A combination of two kinds or more of these treatments may be performed. In addition, an arbitrary surface shape can also be provided on the surface layer.

Further, it is preferable that the transfer body has a compressible layer having a function of absorbing pressure fluctuations. The compressible layer is provided, such that the compressible layer can absorb deformation to disperse local pressure fluctuations, thereby making it possible to maintain satisfactory transferability even during high-speed printing. As a member of the compressible layer, for example, acrylonitrile-butadiene rubber, acrylic rubber, chloroprene rubber, urethane rubber, silicone rubber and the like can be used. At the time of molding such a rubber material, it is preferable to blend predetermined amounts of a vulcanizing agent, a vulcanization accelerator and the like, and further blend a foaming agent, hollow fine particles or a filler such as sodium chloride as needed to form a porous material. In this manner, since bubble portions are compressed with volume changes against various pressure fluctuations, deformation except in a compression direction is small, and more stable transferability and durability can be achieved. As a porous rubber material, there are a material having a continuous pore structure in which pores are connected to each other and a material having an independent pore structure in which pores are independent of each other. In the present exemplary embodiment, either of the structures may be used, or the structures may be used in combination.

Further, the transfer body preferably further includes an elastic layer between the surface layer and the compressible layer. As a member of the elastic layer, various materials such as resins and ceramics can be suitably used. In view of processing properties, various elastomer materials and rubber materials are preferably used. Specific examples thereof can include silicone rubber, fluorosilicone rubber, phenylsilicone rubber, fluororubber, chloroprene rubber, urethane rubber, nitrile rubber, ethylenepropylene rubber, natural rubber, styrene rubber, isoprene rubber, butadiene rubber, ethylene/propylene/butadiene copolymers, nitrile-butadiene rubber and the like. Particularly, since silicone rubber, fluorosilicone rubber and phenylsilicone rubber have a small compression permanent set, these materials are preferable in view of dimensional stability and durability. Further, a change in elastic modulus depending on a temperature is small, and these materials are preferable in view of transferability Various adhesives or double-sided tapes may be used between the respective layers (the surface layer, the elastic layer and the compressible layer) constituting the transfer body in order to fix and hold these layers. Further, a reinforcing layer having a high compressive elastic modulus may be provided in order to suppress lateral elongation when installed in an apparatus or to maintain elasticity. In addition, a woven fabric may be used as the reinforcing layer. The transfer body can be manufactured by optionally combining the respective layers made of the above-mentioned materials.

A size of the transfer body can be freely selected depending on a size of a target print image. A form of the transfer body is not particularly limited. Specific examples of the form of the transfer body can include a sheet form, a roller form, a belt form, an endless web form and the like.

<Support Member>

The transfer body 101 is supported on the support member 102. As a method of supporting the transfer body, various adhesives and double-sided tapes may be used. Alternatively, by attaching an installing member made of a metal, ceramics, a resin or the like to the transfer body, the transfer body may be supported on the support member 102 by using the installing member.

The support member 102 needs to have a certain degree of structural strength in view of conveyance accuracy and durability. As a material of the support member, metals, ceramics, resins and the like are preferably used. Among them, aluminum, iron, stainless steel, acetal resins, epoxy resins, polyimide, polyethylene, polyethylene terephthalate, nylon, polyurethane, silica ceramics and alumina ceramics are preferably used in terms of rigidity capable of withstanding the pressure at the time of transfer, dimensional accuracy and improvement of control responsivity by decreasing inertia during operation. In addition, a combination thereof is preferably used.

<Reaction Liquid Applying Device>

The ink jet printing apparatus according to the present exemplary embodiment includes the reaction liquid applying device 103 applying the reaction liquid onto the transfer body 101. A case in which the reaction liquid applying device 103 is a gravure offset roller having a reaction liquid storage part 103*a* storing the reaction liquid and reaction liquid applying members 103*b* and 103*c* applying the reaction liquid in the reaction liquid storage part 103*a* onto the transfer body 101 is illustrated in FIG. 1.

The reaction liquid applying device may be any device capable of applying the reaction liquid onto the ink receiving medium. Alternatively, various devices known in the art can be suitably used. Specific examples thereof include a gravure offset roller, an ink jet head, a die coating device (die coater), a blade coating device (blade coater) and the like. Application of the reaction liquid by the reaction liquid applying device may be performed before or after the ink is applied as long as the reaction liquid may be mixed (react) with the ink on the ink receiving medium. It is preferable to apply the reaction liquid before the ink is applied. The reaction liquid is applied before the ink is applied, such that bleeding in which adjacently applied inks are mixed with each other at the time of printing an image by the ink jet method or beading in which previously landed ink is attracted to the ink landed later can be also suppressed.

<Reaction Liquid>

The reaction liquid comes in contact with the ink to partially decrease fluidity of the ink and/or an ink composition on the ink receiving medium, thereby making it possible to suppress bleeding or beading at the time of forming an image by ink. More specifically, a reactant (referred to as an ink viscosity increasing component) contained in the reaction liquid comes in contact with the coloring material, the resin or the like, which is a portion of the composition constituting the ink, to thereby chemically react therewith or be physically adsorbed thereto. This causes an increase in the viscosity of the whole ink and a local increase in viscosity due to partial aggregation of the components constituting the ink such as the coloring material, such that the fluidity of the ink and/or the ink composition can be partially decreased.

As the reaction liquid, a reaction liquid coming in contact with the ink to aggregate components (resin, a self-dispersible pigment or the like) having an anionic group in the ink can be mentioned.

Examples of the reactant can include cationic components such as polyvalent metal ions and cationic resins, organic acids and the like.

Examples of the polyvalent metal ions can include divalent metal ions such as $Ca^{2+}$, $Cu^{2+}$, $Ni^{2+}$, $Mg^{2+}$, $Sr^{2+}$, $Ba^{2+}$ and $Zn^{2+}$ or trivalent metal ions such as $Fe^{3+}$, $Cr^{3+}$, $Y^{3+}$ and $Al^{3+}$. In order to contain the polyvalent metal ion in the reaction liquid, a polyvalent metal salt (which may be a hydrate) formed by combining the polyvalent metal ion and an anion can be used. Examples of the anion can include inorganic anions such as $Cl^-$, $Br^-$, $I^-$, $ClO^-$, $ClO_2^-$, $ClO_3^-$, $ClO_4^-$, $NO_2^-$, $NO_3^-$, $SO_4^{2-}$, $CO_3^{2-}$, $HCO_3^-$, $PO_4^{3-}$, $HPO_4^{2-}$ and $H_2PO_4^{2-}$ and organic anions such as $HCOO^-$, $(COO^-)_2$, $COOH(COO^-)$, $CH_3COO^-$, $C_2H_4(COO^-)_2$, $C_6H_5COO^-$, $C_6H_4(COO^-)_2$ and $CH_3SO_3^-$. In the case of using the polyvalent metal ion as the reactant, a content (mass %) in terms of the polyvalent metal salt in the reaction liquid is preferably 1.00 mass % or more to 10.00 mass % or less, based on a total mass of the reaction liquid.

A reaction liquid containing an organic acid has buffering ability in an acidic region (pH of less than 7.0, preferably pH of 2.0 to 5.0), thereby converting anionic groups of components present in the ink into acid forms to aggregate them. Examples of the organic acid can include monocarboxylic acids such as formic acid, acetic acid, propionic acid, butyric acid, benzoic acid, glycolic acid, lactic acid, salicylic acid, pyrrolecarboxylic acid, furancarboxylic acid, picolinic acid, nicotinic acid, thiophenecarboxylic acid, levulinic acid and coumaric acid and salts thereof; dicarboxylic acids such as oxalic acid, malonic acid, succinic acid, glutaric acid, adipic acid, maleic acid, fumaric acid, itaconic acid, sebacic acid, phthalic acid, malic acid and tartaric acid and salts or hydrogen salts thereof; tricarboxylic acids such as citric acid and trimellitic acid and salts or hydrogen salts thereof; and tetracarboxylic acids such as pyromellitic acid and salts and hydrogen salts thereof, etc.

Examples of the cationic resin can include resins having structures of primary to tertiary amines and resins having structures of quaternary ammonium salts, etc. Specific examples thereof can include resins having structures of vinyl amine, allyl amine, vinyl imidazole, vinyl pyridine, dimethyl amino ethyl methacrylate, ethylene imine, guanidine and the like. In order to increase solubility of the reaction liquid, the cationic resin and an acidic compound can be used in combination, or quaternization treatment of the cationic resin can be carried out. In the case of using the cationic resin as the reactant, a content (mass %) of the cationic resin in the reaction liquid is preferably 1.00 mass % or more to 10.00 mass % or less, based on the total mass of the reaction liquid.

As the components other than the reactant in the reaction liquid, water, a water-soluble organic solvent, other additives and the like, which are exemplified as components capable of being used in ink described later, can be used in the same blending amount as those in the ink.

<Ink Applying Device and Auxiliary Liquid Applying Device>

The ink jet printing apparatus according to the present exemplary embodiment includes the ink applying device 104 applying the ink onto the transfer body 101 and the auxiliary liquid applying device 10. The reaction liquid, the ink and the auxiliary liquid are mixed with each other on the transfer body, the ink image is formed by the reaction liquid and the ink, and the liquid component is removed from the ink image by the liquid removing device 105.

In the present exemplary embodiment, as the ink applying device applying the ink and the auxiliary liquid applying device applying the auxiliary liquid, ink jet heads applying ink by an ink jet method are used. Examples of the ink jet head can include an ink jet head ejecting ink by generating film boiling in the ink using an electro-thermal transducer to form bubbles, an ink jet head ejecting ink by electromechanical transducer, an ink jet head ejecting ink using static electricity and the like. In the present exemplary embodiment, an ink jet head known in the art can be used. Among them, particularly, an ink jet head using the electrothermal transducer is preferably used in view of high-speed and high-density printing. Drawing is performed by receiving an image signal and applying a required amount of ink to each position.

In the present exemplary embodiment, the ink jet head is a full line head extendedly installed in the Y direction, and nozzles are arranged in a range covering a width of an image printing region of a printing medium with a maximum usable size. The ink jet head has an ink ejection surface whose nozzles are opened on a lower surface thereof (toward the transfer body 101), and the ink ejection surface faces the surface of the transfer body 101 with a minute gap (about several millimeters) therebetween.

An ink application amount can be expressed by an image density (duty) or an ink thickness, but in the present exemplary embodiment, an average value obtained by multiplying a mass of each ink dot by the number of ink dots and dividing it by a printing area is defined as the ink application amount ($g/m^2$). In addition, a maximum ink application amount in an image region means an ink application amount in an area of at least 5 $mm^2$ in a region used as information of the ink receiving medium in view of removing the liquid component in the ink.

The ink applying device 104 may have a plurality of ink jet heads in order to apply color ink having each color onto the ink receiving medium. For example, in the case of forming respective color images using yellow ink, magenta ink, cyan ink and black ink, the ink applying device has four ink jet heads ejecting four kinds of inks onto the ink receiving medium, respectively, and these ink jet heads are disposed to line up in the X direction.

Further, the ink applying device may include an ink jet head ejecting clear ink that does not contain a coloring material or is substantially transparent due to a significantly small ratio of the coloring material even if the clear ink contains the coloring material. Further, the clear ink can be used together with the reaction liquid and the color ink in order to form the ink image. For example, in order to improve glossiness of the image, this clear ink can be used. It is preferable to suitably adjust a resin component to be blended and further control an ejection position of the clear ink so that the image after the transfer gives a glossy feeling. Since it is preferable that the clear ink is located on a surface layer side as compared to the color ink in a final printed matter, in a transfer type printing apparatus, there is a need to apply the clear ink onto the transfer body 101 before the color ink. To this end, in a movement direction of the transfer body 101 facing the ink applying device 104, the ink jet head for clear ink can be disposed on an upstream side as compared to the ink jet head for color ink.

Further, in the present exemplary embodiment, the clear ink can be used to improve transferability of the image from the transfer body 101 to the printing medium, separately from improving glossiness. For example, the clear ink contains a large amount of a component exhibiting adhesiveness as compared to the color ink to impart adhesiveness to the color ink. A detailed description thereof is provided below. For example, in the movement direction of the transfer body 101 facing the ink applying device 104, the ink jet head for clear ink for improving transferability is disposed in a downstream side as compared to the ink jet head for color ink. Further, after the color ink is applied onto the transfer body 101, the clear ink is applied onto the transfer body after the color ink is applied, such that the clear ink exists on an outermost surface of the ink image. In the transfer of the ink image to the printing medium in a transfer part, the clear ink on the surface of the ink image adheres to the printing medium 108 with a certain degree of adhesive force, whereby the ink image after liquid removal easily moves to the printing medium 108.

<Ink>

Each component of the ink applied to the present exemplary embodiment is described.

(Coloring Material)

As the coloring material contained in the ink applied to the present exemplary embodiment, at least one of pigments and dyes can be used. A content of the coloring material in the ink is preferably 0.5 mass % or more to 15.0 mass % or less and more preferably 1.0 mass % or more to 10.0 mass % or less, based on the total mass of the ink.

The kind of pigment capable of being used as the coloring material is not particularly limited. Specific examples of the pigment can include inorganic pigments such as carbon black and titanium oxide; and organic pigments such as azo based pigments, phthalocyanine based pigments, quinacridone based pigments, isoindolinone based pigments, imidazolone based pigments, diketopyrrolopyrrole based pigments and dioxazine based pigments. If necessary, one or two kinds or more of these pigments can be used. A dispersion method of the pigment is not particularly limited. For example, a resin-dispersed pigment dispersed by a resin dispersant, a self-dispersible pigment in which a hydrophilic group such as an anionic group is bonded to a particle surface of the pigment directly or through another atomic group, etc. can be used. Of course, pigments of which dispersion methods are different from each other can be used in combination.

As the resin dispersant for dispersing the pigment, a resin dispersant known in the art, used in aqueous ink for ink jet can be used. Among them, an acrylic water-soluble resin dispersant simultaneously having a hydrophilic unit and a hydrophobic unit in a molecular chain is preferably used in the present exemplary embodiment. As a form of the resin, there are a block copolymer, a random copolymer, a graft copolymer, a combination of these copolymers, etc.

The resin dispersant in the ink may be in a state in which the resin dispersant is dissolved in a liquid medium or a state in which the resin dispersion is dispersed in a liquid medium as resin particles. As used herein, the resin is water-soluble, which means that the resin does not form particles of which a diameter can be measured by a dynamic light scattering method when the resin is neutralized with an alkali in a molar amount equivalent to an acid value.

The hydrophilic unit (unit having a hydrophilic group such as an anionic group) can be formed by polymerizing, for example, a monomer having a hydrophilic group. Specific examples of the monomer having a hydrophilic group can include acidic monomers having an anionic group such as (meth)acrylic acid and maleic acid, anionic monomers such as anhydrides or salts of these acid monomers and the like. Examples of cations constituting the salts of the acidic monomers can include lithium, sodium, potassium, ammonium and organic ammonium ions.

The hydrophobic unit (unit having no hydrophilic group such as an anionic group) can be formed, for example, by polymerizing a monomer having a hydrophobic group. Specific examples of the monomer having a hydrophobic group can include monomers having an aromatic ring such as styrene, α-methylstyrene and benzyl(meth)acrylate; monomers having an aliphatic group (that is, (meth)acrylic ester based monomers) such as ethyl(meth)acrylate, methyl (meth)acrylate and butyl(meth)acrylate and the like.

An acid value of the resin dispersant is preferably 50 mgKOH/g or more to 550 mgKOH/g or less and more preferably 100 mgKOH/g or more 250 mgKOH/g or less. Further, a weight average molecular weight of the resin dispersant is preferably 1,000 or more to 50,000 or less. A content (mass %) of the pigment is preferably 0.3 times or more to 10.0 times or less as a mass ratio with respect to a content of the resin dispersant.

As the self-dispersible pigment, a self-dispersible pigment in which an anionic group such as a carboxylic acid group, a sulfonic acid group, a phosphonic acid group or the like is bonded to a particle surface of the pigment directly or through another atomic (—R—) group can be used. The anionic group may be in an acid or salt form. In the case in which the anionic group is in the salt form, the anionic group may be in a state in which the anionic group is partially disassociated or a state in which it is completely disassociated. When the anionic group is in the salt form, examples of cations corresponding to counter ions can include alkaline metal cations; ammonium; organic ammonium; and the like. Specific examples of another atomic (—R—) group can include a linear or branched alkylene group having 1 to 12 carbon atoms; arylene groups such as a phenylene group and a naphthylene group; an amide group; a sulfonyl group; an amino group; a carbonyl group; an ester group; an ether group and the like. Further, another atomic group may be a combination of these groups.

The kind of dyes capable of being used as the coloring material is not particularly limited, but it is preferable to use a dye having an anionic group. Specific examples of the dye can include azo based dyes, triphenylmethane based dyes, (aza)phthalocyanine based dyes, xanthene based dyes, anthrapyridone based dyes and the like. If necessary, one or two kinds or more of these dyes can be used.

Further, in the present exemplary embodiment, it is also preferable to use a so-called self-dispersible pigment in which the pigment itself is surface-modified so that the pigment can be dispersed without using a dispersant.

(Resin Particle)

The ink applied to the present exemplary embodiment can contain resin particles. The resin particles do not need to contain the coloring material. The resin particles are preferable in that the resin particles may have an effect on improving image quality or fixability.

A material of the resin particles capable of being used in the present exemplary embodiment is not particularly limited, but a resin known in the art can be suitably used. Specific examples thereof can include resin particles made of various materials such as olefin based materials, styrene based materials, urethane based materials, acrylic materials and the like. A weight average molecular weight (Mw) of the resin particles is preferably 1,000 or more to 2,000,000 or less. A volume average particle diameter of the resin particles measured by a dynamic light scattering method is preferably 10 nm or more to 1,000 nm or less and more preferably 100 nm or more to 500 nm or less. A content (mass %) of the resin particles in the ink is preferably 1.0 mass % or more to 50.0 mass % or less and more preferably 2.0 mass % or more to 40.0 mass % or less, based on the total mass of the ink.

(Aqueous Medium)

Water or an aqueous medium corresponding to a mixed solvent of water and a water-soluble organic solvent can be contained in the ink capable of being used in the present exemplary embodiment. It is preferable to use deionized water or ion-exchange water as the water. A content (mass %) of the water in aqueous ink is preferably 50.0 mass % or more to 95.0 mass % or less, based on the total mass of the ink. Further, a content (mass %) of the water-soluble organic solvent in aqueous ink is preferably 3.0 mass % or more to 50.0 mass % or less, based on the total mass of the ink. As the water-soluble organic solvent, any water-soluble organic solvent such as alcohols, (poly)alkylene glycols, glycol ethers, nitrogen-containing compounds and sulfur-containing compounds can be used as long as it can be used in the ink for ink jet. One or two kinds or more of these water-soluble organic solvents can be contained.

(Other Additives)

If necessary, various additives such as a defoaming agent, a surfactant, a pH adjusting agent, a viscosity modifier, a rust preventing agent, an antiseptic, an antifungal agent, an antioxidant, a reduction inhibitor and a water-soluble resin in addition to the above-mentioned components may be contained in the ink capable of being used in the present exemplary embodiment.

<Auxiliary Liquid>

The auxiliary liquid corresponding to a transfer assisting liquid containing a thermoplastic resin serving as a binder in the ink image is applied onto the transfer body. This improves transferability to the printing medium. The auxiliary liquid may be either aqueous or non-aqueous, but it is preferable that the auxiliary liquid contains a water-soluble thermoplastic resin and wax particles.

In the present exemplary embodiment, the term "water-soluble thermoplastic resin" means a resin capable of being dissolved in water. The kind of water-soluble thermoplastic resin for the auxiliary liquid is not particularly limited as long as a binder function to be desired can be achieved. It is preferable to change the kind of water-soluble thermoplastic resin depending on the kind of auxiliary liquid applying unit. For example, when the auxiliary liquid applying unit is an ink jet device, a water-soluble thermoplastic resin having a weight average molecular weight of 2000 or more to 20000 or less is preferable. Further, a water-soluble thermoplastic resin having a weight average molecular weight of 5000 or more to 10000 or less is more preferable. In addition, when the auxiliary liquid applying unit is a roller applying device, a water-soluble thermoplastic resin having a larger weight average molecular weight can also be used.

A glass transition temperature (glass transition point: Tg) of the water-soluble thermoplastic resin and a melting point (Tm) of the wax particles are preferably 40° C. or more to 150° C. or less. Further, in the case of setting a transfer temperature by a softening point or the melting point, a water-soluble thermoplastic resin having a softening point or melting point of 40° C. or more to 150° C. or less is preferable.

Specific examples of the water-soluble thermoplastic resin can include a block copolymer, a random copolymer or a graft copolymer composed of at least two monomers (at least one of them is a hydrophilic polymerizable monomer) selected from styrene, styrene derivatives, vinyl naphthalene, vinyl naphthalene derivatives, aliphatic alcohol esters of α,β-ethylenic unsaturated carboxylic acid, acrylic acid, acrylic acid derivatives, maleic acid, maleic acid derivatives, itaconic acid, itaconic acid derivatives, fumaric acid, fumaric acid derivatives, vinyl acetate, vinyl alcohol, vinyl pyrrolidone, acrylamide and derivatives thereof or salts thereof. Further, natural resins such as rosin, shellac and starch can be preferably used. These water-soluble resins are alkali-soluble resins capable of being dissolved in an aqueous solution in which a base is dissolved. Particularly, a water-soluble resin having a hydrophobic portion is preferable. The hydrophobic portion is not particularly limited, but preferably has a functional group having an unsaturated bond such as a styrene group.

A composition of one or two kinds or more of these water-soluble resins can be used as a component of the auxiliary liquid.

In the present exemplary embodiment, it is also preferable that the auxiliary liquid contains the wax particles. The wax particles are preferably particles containing solid wax or wax having a melting point at room temperature.

In the present exemplary embodiment, transferability to a printing medium having a coating layer is significantly improved by applying the auxiliary liquid containing the wax particles and transferring the ink image by heating. The reason is not clear but is estimated that adhesive force between the wax particles and the coating layer of the printing medium is high. Since an effect of controlling an application amount and an application area of the auxiliary liquid is increased depending on the kind of paper by using this effect, it is preferable that the wax particles are contained in the auxiliary liquid.

Examples of a wax component contained in the wax particles can include natural waxes and synthetic waxes.

Examples of the natural waxes can include petroleum based waxes, vegetable waxes and animal and vegetable waxes.

Examples of the petroleum based waxes can include paraffin wax, microcrystalline wax, petrolatum and the like. Further, examples of the vegetable waxes can include carnauba wax, candelilla wax, rice wax, Japan wax and the like.

In addition, examples of the animal and vegetable waxes can include lanolin, beeswax and the like.

Examples of the synthetic waxes can include synthetic hydrocarbon based waxes, modified wax systems and the like.

Examples of the synthetic hydrocarbon based waxes can include polyethylene wax, Fischer-Tropsch wax and the like. Further, examples of the modified wax systems can include paraffin wax derivatives, montan wax derivatives, microcrystalline wax derivatives and the like. One of them may be used alone, or a combination of two or more thereof may be used.

It is preferable to use the wax particles to prepare the auxiliary liquid in a form of a wax particle dispersion in which the wax particles are dispersed in a liquid. It is preferable that the wax particles are formed by dispersing a wax component using a dispersant. The dispersant is not particularly limited, but for example, a dispersant known in the art can be used. Further, it is preferable to select the kind of dispersant in consideration of stability of a dispersion state of the wax particles in the auxiliary liquid. In addition, it is also possible to disperse the wax particles using the above-mentioned water-soluble resin as a binder component as a dispersant.

A volume average molecular weight of the wax particles is preferable 10 nm to 1000 nm or less and more preferably 50 nm to 500 nm or less in view of improving of transfer efficiency. When the volume average molecular weight of the wax particles is within the above-mentioned range, the wax particle is more easily held on an ink aggregation layer. As a result, it is thought that at the time of transfer, a larger amount of wax particles can be filled in gaps of an interface between the printing medium and an ink receiving layer, thereby making it possible to further improve transfer efficiency.

A content of the water-soluble thermoplastic resin in the auxiliary liquid is preferably 0.1 mass % or more to 20 mass % or less, based on a total mass of the auxiliary liquid. The content of the water-soluble thermoplastic resin is more preferably 0.1 mass % or more to 10 mass % or less and further more preferably 0.1 mass % or more to 5 mass % or less, based on the total mass of the auxiliary liquid. By setting the content of the water-soluble thermoplastic resin in the above-mentioned ranges, characteristics such as ejection stability in the case of ejecting the auxiliary liquid from the ink jet device, landing position accuracy of the ejected liquid droplet and uniformity of an application state in the case of the roller application can be improved.

Further, the content of the wax particles is preferably 0.5 mass % or more to 20 mass % or less and more preferably 1 mass % or more to 10 mass % or less, based on the total mass of the auxiliary liquid. A mass ratio of the water-soluble resin and the wax particles in the auxiliary liquid is selected in a range of preferably 3:1 to 1:10 and more preferably 1:1 to 1:10 (content of the water-soluble resin: content of the wax particles).

In addition, it is preferable that the auxiliary liquid contains resin particles. As the resin particles for the auxiliary liquid, the above-mentioned resin particles for ink can be used. In this manner, it is possible to suppress movement of a second intermediate image on the transfer body of the ink applied onto the transfer body and to improve image fastness on the printing medium. Further, strength of an auxiliary liquid layer is increased by adding the resin particles, thereby also improving transferability.

A mass ratio of the resin particles and the wax particles is selected in a range of preferably 10:1 to 1:20 and more preferably 5:1 to 1:10 (resin particles:wax particles). The resin particles can be more effectively used by selecting the ratio of the resin particles and the wax particles in the above-mentioned ranges.

In addition, surface tension of the auxiliary liquid is preferably lower than that of the ink. In this manner, the auxiliary liquid spreads on the transfer body, thereby making it possible to improve a contact property with the ink.

Further, a glass transition temperature Tg of the resin particles is preferably 30° C. or more to 150° C. or less.

The auxiliary liquid may further contain various additives such as a surfactant used in ink, a water-soluble organic solvent modifier, a rust preventing agent, an antiseptic, an antifungal agent, an antioxidant, a reduction inhibitor, a water-soluble resin and a neutralizing agent thereof and a viscosity modifier in addition to each of the components described above.

As a liquid medium used when the auxiliary liquid is non-aqueous, organic solvents known in the art may be used, but alcohol based organic solvents such as methanol and ethanol are preferable.

(Measurement of Melting Point of Wax Particles)

The melting point of the wax particles can be measured according to the temperature measurement pattern of ASTM D3418. More specifically, the melting point of the wax particles can be determined as a peak top value of a maximum melting temperature measured according to the temperature measurement pattern of ASTM D3418 using DSC-7 (Perkin Elmer Inc.) at a heating rate of 10° C./min.

The auxiliary liquid is applied so as to cover the ink image with a wider area in a plane direction than a portion to which the ink is applied. Therefore, for example, even when dislocation of the ink application position occurs, the ink image can be stably transferred. Further, as described below, an auxiliary liquid application amount is controlled at least by (I) and/or (II) described above.

<Liquid Removing Device>

The liquid removing device 105 according to the present exemplary embodiment is a liquid absorbing device having the liquid absorbing member 105*a* and a pressing member 105*b* for liquid absorption which presses the liquid absorbing member 105*a* against the ink image on the transfer body 101. Further, shapes of the liquid absorbing member 105*a* and the pressing member 105*b* are not particularly limited. For example, as illustrated in FIG. 1, the liquid absorbing member 105*a* and the pressing member 105*b* may have a configuration in which the pressing member 105*b* has a column shape, the liquid absorbing member 105*a* has a belt shape, and the column-shaped pressing member 105*b* presses the belt-shaped liquid absorbing member 105*a* against the transfer body 101. Alternatively, the liquid absorbing member 105*a* and the pressing member 105*b* may also have a configuration in which the pressing member 105*b* has a column shape, the liquid absorbing member 105*a* has a cylindrical shape formed on a peripheral surface of the pressing member 105*b* having the column shape, and the column-shaped pressing member 105*b* presses the cylindrical liquid absorbing member 105*a* against the transfer body.

In the present exemplary embodiment, it is preferable that the liquid absorbing member 105*a* has a belt shape in consideration of a space in the ink jet printing apparatus, etc.

Further, the liquid absorbing device 105 including the belt-shaped liquid absorbing member 105*a* described above may also include an extending member extending the liquid absorbing member 105*a*. In FIG. 1, reference numeral 105*c* denotes an extending roller as the extending member. In FIG. 1, the pressing member 105*b* is a rotating roller member similarly to the extending roller, but is not limited thereto.

In the liquid absorbing device 105, the liquid absorbing member 105*a* including a porous body is pressed by the pressing member 105*b* to come in contact with the ink image, such that the liquid absorbing member 105*a* absorbs the liquid component contained in the ink image, thereby decreasing the liquid component.

As a method of removing and decreasing the liquid component in the ink mage, instead of the present method of contacting the above-mentioned liquid absorbing member with the ink image, another method, for example, a heating method, a method of blowing air with low humidity or a decompression method, etc. may be used. Further, the liquid component may be further decreased by additionally applying these methods to the ink image after liquid removal from which the liquid component has been decreased as well as the method of contacting the above-mentioned liquid absorbing member with the ink image.

<Liquid Absorbing Member>

In the present exemplary embodiment, a content of the liquid component in the ink image is decreased by contacting the liquid component in the ink image before liquid removal with the liquid absorbing member having the porous body to at least partially absorb and remove the liquid component therefrom. A contact surface of the liquid absorbing member with the ink image is defined as a first surface, and the porous body is disposed on the first surface. It is preferable that the liquid absorbing member having the porous body as described above has a shape in which the liquid absorbing member can move in sync with movement of the ink receiving medium and perform liquid absorption by circulating at a predetermined cycle to contact another ink image before liquid removal again after coming into contact with the ink image. For example, the liquid absorbing member can have an endless belt shape, a drum shape or the like.

(Porous Body)

As the porous body of the liquid absorbing member according to the present exemplary embodiment, it is preferable to use a porous body having an average pore diameter on a first surface side smaller than an average pore diameter on a second surface side opposing the first surface. In order to suppress the coloring material in the ink from being attached to the porous body, it is preferable that the pore diameter is small, and the average pore diameter of the porous body on at least the first surface side, coming in contact with the image is 10 μm or less. Further, as used herein, the average pore diameter means an average diameter at the first or second surface, and can be measured by a method known in the art, for example, a mercury press-in method, a nitrogen adsorption method, an SEM image observation method or the like.

Further, it is preferable to decrease a thickness of the porous body in order to have uniformly high air permeability. Air permeability can be expressed by a Gurley value defined in JIS P8117, and it is preferable that the Gurley value is 10 seconds or less.

However, in the case of decreasing the thickness of the porous body, since the porous body may fail to secure a capacity enough to absorb the liquid component, the porous body can have a multilayer configuration. Further, in the liquid absorbing member, it is preferable that a layer coming in contact with the ink image is the porous body, and a layer that does not come in contact with the ink image may not be the porous body.

As described above, the ink image in which the liquid component is removed to thereby be decreased is formed on the transfer body 101. The ink image after liquid removal is transferred to the printing medium 108 in the transfer part 111 later. A device configuration and conditions at the time of transfer are described.

<Pressing Member for Transferring>

In the present exemplary embodiment, the ink image after liquid removal on the transfer body 101 is allowed to come in contact with the printing medium 108 conveyed by the printing medium conveyance device 107 by the pressing member 106 for transferring to thereby be transferred to the printing medium 108. A transfer unit in the present exemplary embodiment includes the pressing member 106 for transferring and the support member 102 of the intermediate transfer body 101. A transfer process by the transfer unit is performed by contacting the second intermediate image on the transfer body with the printing medium and separating the second intermediate image from the transfer body while maintaining a contact state with the printing medium to transfer the second intermediate image to the printing medium.

It is possible to obtain a printing image in which curls, cockling or the like is suppressed by removing the liquid component contained in the ink image (second intermediate image) on the transfer body 101 and then transferring the ink image to the printing medium 108.

The pressing member 106 needs to have a certain degree of structural strength in view of conveyance accuracy of the printing medium 108 and durability. As a material of the pressing member 106, metals, ceramics, resins and the like are preferably used. Among them, particularly, in order to improve control responsivity by decreasing inertia during operation as well as rigidity capable of withstanding the pressure at the time of transfer or dimensional accuracy, aluminum, iron, stainless steel, acetal resins, epoxy resins, polyimide, polyethylene, polyethylene terephthalate, nylon, polyurethane, silica ceramics and alumina ceramics are preferably used. In addition, a combination thereof may also be used.

A pressing time during which the pressing member 106 presses the transfer body 101 in order to transfer the ink image after liquid removal on the transfer body 101 to the printing medium 108 is not particularly limited, but is preferably 5 ms or more to 100 ms or less in order to satisfactorily transfer the ink image and not to degrade durability of the transfer body. Further, in the present exemplary embodiment, the pressing time indicates a time during which the printing medium 108 and the transfer body 101 come in contact with each other, and is calculated by performing surface pressure measurement using a surface pressure distribution measuring device (trade name: "I-SCAN", manufactured by Nitta Corporation) and dividing a length of a pressed region in a conveyance direction by a conveyance speed.

Further, a pressure at which the pressing member 106 presses the transfer body 101 in order to transfer the ink image after liquid removal on the transfer body 101 to the printing medium 108 is not particularly limited, but is controlled so as to satisfactorily transfer the ink image and not to degrade durability of the transfer body. Therefore, it is preferable that the pressure is 9.8 $N/cm^2$ (1 $kg/cm^2$) or more to 294.2 $N/cm^2$ (30 $kg/cm^2$) or less. Further, in the present exemplary embodiment, the pressure indicates a nip pressure between the printing medium 108 and the transfer body 101 and is calculated by performing surface pressure measurement using a surface pressure distribution measuring device and dividing a load in a pressed region by an area.

A temperature when the pressing member 106 presses the transfer body 101 in order to transfer the ink image after liquid removal on the transfer body 101 to the printing medium 108 is preferably equal to or more than a softening point of the resin component contained in the ink. Further, it is preferable that the wax particles are contained in the auxiliary liquid and the temperature is equal to or more than the melting point of the wax. In addition, as illustrated in FIG. 1, for heating, it is preferable to provide a heating unit 11 heating the image on the transfer body 101 and the transfer body 101. As the heating unit, hot air, infrared (IR) light or the like known in the art can be used, but in view of high energy efficiency, it is preferable to perform the heating using the IR light. A shape of a transfer unit 106 is not particularly limited, but the transfer unit 106 can have, for example, a roller shape.

<Printing Medium and Printing Medium Conveyance Device>

In the present exemplary embodiment, the printing medium 108 is not particularly limited, and any printing medium known in the art can be used. Examples of the printing medium can include long media rolled in a roll shape or sheet media cut at a predetermined size. Materials thereof can include paper, plastic films, wood boards, corrugated cardboards, metal films and the like.

Further, in FIG. 1, the printing medium conveyance device 107 for conveying the printing medium 108 is composed of a printing medium supply roller 107*a* and a printing medium winding roller 107*b*, but may be composed of any members capable of conveying the printing medium, and is not specifically limited to this configuration.

<Control of Auxiliary Liquid Application Amount>

Control of the auxiliary liquid application amount in the present exemplary embodiment is described below.

The auxiliary liquid is used in order to improve adhesive force between the image and the printing medium at the time of transfer as described above. That is, adhesive force of the auxiliary liquid with the printing medium is stronger than that of the ink. Therefore, it is possible to satisfactorily transfer the image by increasing a contact area between the printing medium and the auxiliary liquid to increase adhesive force between the image and the printing medium. However, in the case of increasing the auxiliary liquid application amount in order to increase the contact area between the printing medium and the auxiliary liquid, a used amount of the auxiliary liquid is increased, such that a running cost is increased. Therefore, there is a need to use the auxiliary liquid at a minimum application amount at which the image can be satisfactorily transferred.

As described above, the control of the auxiliary liquid application amount for efficiently applying the auxiliary liquid in an auxiliary liquid amount control process includes at least one of the following (I), (II) and (III).

(I) In a plane direction of the image forming surface of the transfer body, a region which includes the first intermediate image on the image forming surface and is wider than the first intermediate image is set as an auxiliary liquid application region and the auxiliary liquid is applied onto the auxiliary liquid application region in the auxiliary liquid applying process. Further, an area difference between an area of the first intermediate image and an area of the auxiliary liquid application region in the plane direction of the image forming surface in the case in which the area of the first intermediate image is a second area (first area<second area) is set to be smaller than that in the case in which the area of the first intermediate image is a first area.

(II) In a plane direction of the image forming surface, a region which includes the first intermediate image on the image forming surface and is wider than the first intermediate image is set as an auxiliary liquid application region and the auxiliary liquid is applied onto the auxiliary liquid application region in the auxiliary liquid applying process. Further, an area difference between an area of the first intermediate image and an area of the auxiliary liquid application region in the plane direction of the image forming surface is changed depending on the kind of paper.

(III) The auxiliary liquid contains wax particles and at the same time, the ink jet printing method further includes a heating process of heating the transfer body at a temperature equal to or more than a melting point of the wax particles. Further, an auxiliary liquid application amount when the printing medium is coated paper is set to be smaller than an auxiliary liquid application amount per area of the image forming surface when the printing medium is not coated paper.

In the present exemplary embodiment, the first and second intermediate images are ink images formed by the ink applied onto the image forming surface of the transfer body. As a form of the ink image as the first intermediate image, there are a dot shaped ink image, a linear ink image and various pattern shaped ink images (including a solid coating portion), etc. and the ink image is formed in a form of at least one of them. Further, a portion of the image forming surface of the transfer body onto which the ink is not applied is referred to as a non-image region.

In order to more effectively obtain transferability to be desired, it is preferable that the auxiliary liquid application region is a region enclosed by an outer edge extended from an entire outer edge of the first intermediate image toward an outer side of the first intermediate image in the plane direction of the image forming surface of the transfer body.

In the present exemplary embodiment, as the area of the first intermediate image, an area of an independent ink image is used. This independent image means a single ink image having an ink dot or an ink image composed of a plurality of minimum disposition units are continuously adjacent to one another in a matrix in which the minimum disposition units of the ink dot are assembled. The independent image is enclosed by the non-image region composed of minimum disposition units onto which the ink dot is not applied and has an outer edge coming in contact with this non-image region.

In the independent image composed of the plurality of minimum disposition units onto which the ink dots are disposed, a state in which the ink dots are continuously arranged in the minimum dot unit of the ink dots is recognized as connection of the ink images, and an area in a range in which the ink images are connected to each other is used as the area of the first intermediate image.

In the control (I), the region including the independent ink image and non-image region around the independent ink image is set as the auxiliary liquid application region, and an area of the auxiliary liquid application region is controlled depending on the area of the independent ink image. The following control can be used as an example of the control in the arrangement of the minimum disposition units onto which the ink dot is applied.

(a) When the independent ink image is an image of 1 dot×1 dot (single dot), an over-application amount of the auxiliary liquid application region in the plane direction is set to correspond to three dots.

(b) When the independent ink image is an image of 3 dots×3 dots (planar array of 9 dots), an over-application amount of the auxiliary liquid application region is set to correspond to one dot.

In the control, an area difference (that is, the over-application amount) between the independent ink image and the auxiliary liquid application region is controlled so that the larger the area of the independent ink image, the smaller the area difference. Therefore, the larger the independent ink image, the smaller the over-application amount. Therefore, the area of the independent ink image can be calculated from image data, and a minimum over-application amount of the auxiliary liquid to be required can be obtained. It is preferable to suitably change a change degree of the over-application amount depending on the kind of paper and transfer conditions.

The area difference (that is, the over-application amount) between the independent ink image and the auxiliary liquid application region does not need to be linearly increased as the area of the independent ink image is increased. It is possible to set the area difference step by step so that as compared to the case in which the area of the independent ink image is the first area, in the case in which the area of the independent ink image is the second area (the first area<the second area), the area difference (that is, the over-application amount) between the independent ink image and the auxiliary liquid application region is decreased. It is estimated that even though the kind of printing medium is changed, for example, surface roughness of the printing medium is large, the auxiliary liquid at least partially comes in contact with the printing medium by changing the over-application amount to apply the auxiliary liquid, and thus transferability becomes satisfactory.

In the control (II), it is possible to efficiently control the auxiliary liquid application amount by changing the area difference between the independent ink image and the auxiliary liquid application region depending on the kind of printing medium.

The kinds of printing medium can be classified depending on characteristics or structure of a printing medium and the like, for example, surface roughness (size of unevenness) of a surface to which the image is transferred or presence or absence of a coating layer.

For example, when the surface roughness of the printing medium is small, particularly, in the case in which the printing medium has a coating layer, it is preferable to control an over-application amount of the auxiliary liquid to be small as compared to the case in which surface roughness of the printing medium is large. In this manner, it is possible to apply the auxiliary liquid with a minimum amount as possible.

In the control (III), the auxiliary liquid application amount per area is controlled depending on the presence or absence of a coating layer of the printing medium. In this manner, it is possible to apply the auxiliary liquid at a minimum amount as possible. The reason is thought that a difference in adhesive force with the printing medium depending on the presence or absence of the coating layer is increased due to the wax particles contained therein as described above. Further, it is preferable that the auxiliary liquid application region is wider than an ink image application region.

At least one of the following controls may be added in addition to the above-mentioned controls (I), (II) and (III).

(i) An auxiliary liquid application amount per area of the image forming surface is changed depending on the kind of printing medium.

(ii) An auxiliary liquid application amount is changed depending on a use history of the transfer body.

(iii) An auxiliary liquid application amount per area of the image forming surface is controlled depending on a length of the first intermediate image in the plane direction of the image forming surface.

(iv) An auxiliary liquid application amount per area of the image forming surface is controlled depending on an ink thickness of the first intermediate image.

According to the control (i), it is preferable to change an amount of the auxiliary liquid applied to the auxiliary liquid application region per unit area depending on the kind of printing medium. For example, in the case of a printing medium having a coating layer, it is preferable to control the auxiliary liquid application amount per unit area to be small as compared to the case in which surface roughness of the printing medium is large. In this manner, it is possible to apply the auxiliary liquid at a minimum amount as possible.

Further, in the control (iv), it is preferable to control an application amount of the auxiliary liquid adjacent to each of the ink images per area as well as the auxiliary liquid on each of the ink images. In this way, it is possible to apply the auxiliary liquid at a minimum amount as possible.

According to the control (iii), it is preferable to control an area of the auxiliary liquid application region depending on a length of each independent ink image in each plane direction. For example, in the case of an image having one-dot length in an X-axis direction and four-dot length in a Y-axis dot direction when a minimum disposition unit is disposed in a form of a matrix on a plane defined by X and Y axes, it is preferable to control an over-application amount of auxiliary liquid to be large in a portion in which a length of the ink image is short. For example, the over-application amount of the auxiliary liquid can be controlled to correspond to 3 dots in the X-axis direction and 1 dot in the Y-axis direction. In this manner, it is possible to apply the auxiliary liquid with a minimum amount as possible.

Further, according to the control (iv), it is preferable to control the auxiliary liquid application amount depending on the thickness of the ink image as well as the area of each ink image in the plane direction. For example, when the thickness of the ink image is thick, it is preferable to decrease the auxiliary liquid application amount. In this manner, it is possible to apply the auxiliary liquid with a minimum amount as possible.

Further, according to the control (ii), it is also preferable to control the auxiliary liquid application amount to be increased even in the case in which transferability is deteriorated depending on the use history of the transfer body or transfer conditions. It is possible to more stably transfer the image by controlling the auxiliary liquid application amount depending on the use history of the transfer body or the like.

Further, the over-application amount of the auxiliary liquid can be determined using a theoretical value based on formation conditions of the ink image and application conditions of the auxiliary liquid, etc. Alternatively, the over-application amount may be determined based on data obtained by separately confirming transferability in the case of changing the over-application amount to confirm a relationship between the over-application amount and transferability.

Further, a region to which the auxiliary liquid is not applied may be included in the auxiliary liquid application region depending on formation conditions of the first intermediate image such as the ink application amount, the kind of printing medium or the like as long as transferability to be desired is obtained.

<Control Unit>

Figure 2:
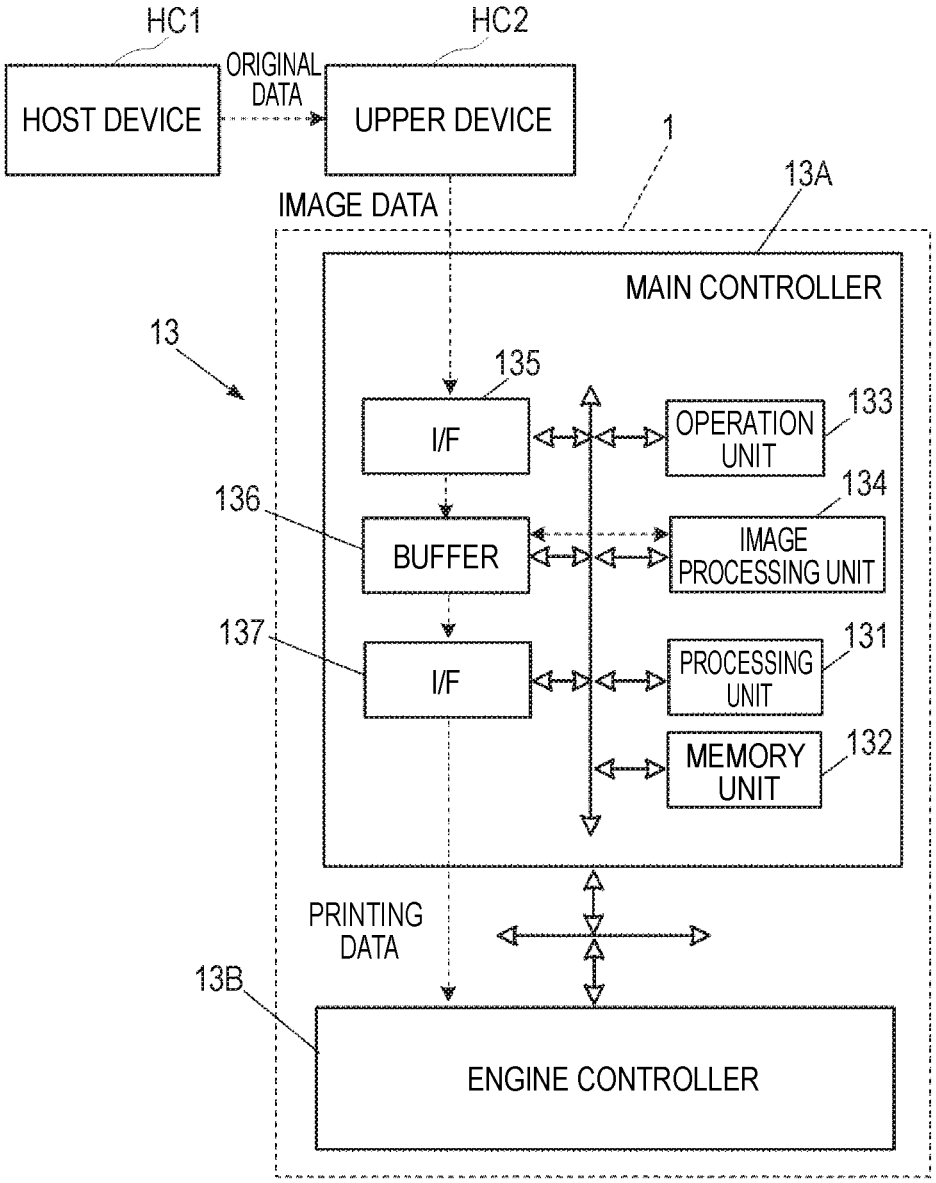
FIG. 2 is a block diagram of a control system of the transfer type ink jet printing apparatus of FIG. 1.
Figure 3:
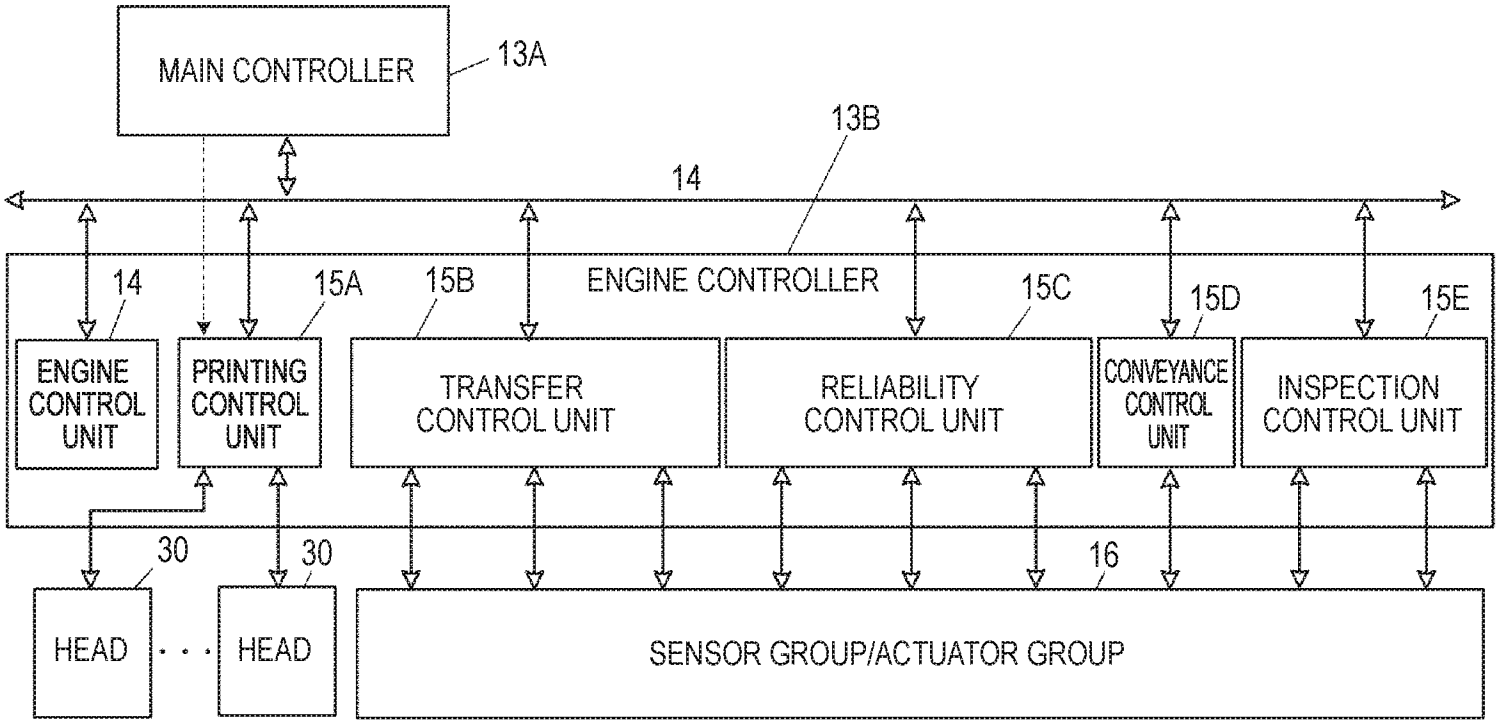
FIG. 3 is a block diagram of the control system of the transfer type ink jet printing apparatus of FIG. 1.

Next, a control unit including an auxiliary liquid amount control unit of a printing system controlling the auxiliary liquid application amount is described. FIGS. 2 and 3 are block diagrams of a control unit 13 of a printing system 1. The control unit 13 is communicably connected to an upper device HC2 (DFE) and the upper device HC2 is communicably connected to a host device HC1.

In the host device HC1, original data that is a basis of a printed image is generated or stored. Here, the original data is formed in a form of an electronic file, for example, a document file, an image file or the like. The original data is transmitted to the upper device HC2, and in the upper device HC2, the received original data is converted into a data format (for example, RGB data representing an image in RGB) usable in the control unit 13.

Data after conversion is transmitted from the upper device HC2 to the control unit 13 as image data, and the control unit 13 starts a printing operation based on the received image data.

In the present exemplary embodiment, the control unit 13 is largely divided into a main controller 13A and an engine controller 13B. The main controller 13A includes a processing unit 131, a memory unit 132, an operation unit 133, an image processing unit 134, a communication interface (I/F) 135, a buffer 136 and a communication I/F 137.

The processing unit 131 is a processor such as a CPU, executes a program stored in the memory unit 132 and performs a control on an entire main controller 13A. The memory unit 132 is a memory device such as a RAM, a ROM, a hard disk, an SSD or the like, stores the program executed by the CPU 131 or data and also provides a work area to the CPU 131. The operation unit 133 is an input device, for example, a touch panel, a key board, a mouse or the like and receives a user's command.

Figure 9:
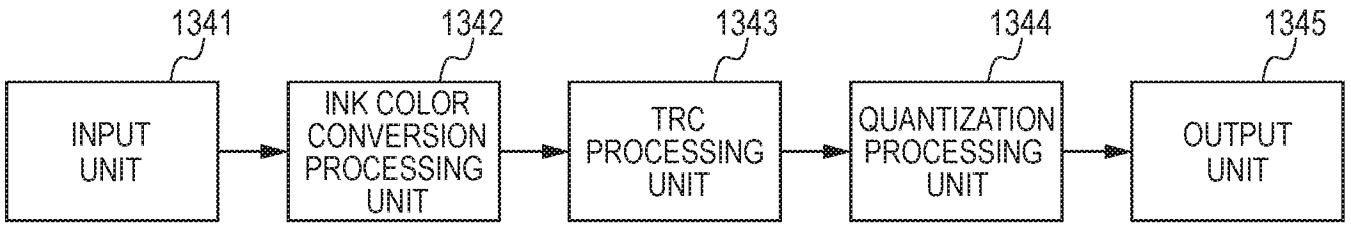
FIG. 9 is a block diagram of a control system of the transfer type printing apparatus of FIG. 1.

The image processing unit 134 is, for example, an electronic circuit having an image processing processor. FIG. 9 is a block diagram illustrating a configuration of image processing of the image processing unit 134. However, application of the present invention is not limited thereto. For example, the image processing unit may be configured in the upper device HC2 illustrated in FIG. 2, or a part of the image processing unit may be configured in the upper device HC2 and the other part may be configured in the control unit 13.

As illustrated in FIG. 9, an input unit 1341 transfers image data received from the upper device HC2 to an ink color conversion processing unit 1342. The ink color conversion processing unit 1342 converts the input image data received from the input unit 1341 to image data corresponding to a color reproduction region of the ink jet printing apparatus. In the present embodiment, the image data to be input is a data indicating color coordinates (R, G, and B) among color space coordinates such as sRGB corresponding to presentation colors of a monitor. The ink color conversion processing unit 1342 converts 8-bit R, G, and B input image data into image data (R', G' and B') in the color reproduction region of a printer according to an existing method such as matrix operation processing or processing using a three-dimensional LUT. In the present embodiment, conversion processing is performed using a three-dimensional lookup table (3-DLUT) and combining interpolation operation. Further, in the present embodiment, a resolution of the 8-bit image data processed by the image processing unit 134 is 600 dpi, and a resolution of a secondary data obtained by quantization in a quantization processing unit 1344 is 1200 dpi as described below.

A tone reproduction curve (TRC) processing unit 1343 performs correction for adjusting the number of dots printed by an output unit 1345 for each ink color with respect to image data composed of each 8-bit ink color signal. Generally, the number of dots printed on the printing medium and an optical density implemented on the printing medium by the number of dots do not have a linear relation. Therefore, the TRC processing unit 1343 adjusts the number of dots printed on the printing medium by correcting each of the 8-bit image data in order to allow this relation to be a linear relation.

The quantization processing unit 1344 performs quantization processing on 8-bit and 256-value image data of each ink color processed by the TRC processing unit 1343 to generate 1-bit binary data that specify whether to print "1" or not print "0". A configuration of a quantization processing unit 1344 is not particularly limited in the application of the present invention. For example, the quantization processing unit 1344 may directly convert the 8-bit image data into a binary data (dot data). Alternatively, the quantization processing unit 1344 may quantize the 8-bit image data into multi-value data of several bits once and finally convert the quantized multi-value data into a binary data. In addition, as a quantization method, an error diffusion method may be used, or other pseudo halftoning processes such as a dither method or the like may be used.

The output unit 1345 drives a printing head based on the binary data (dot data) obtained by quantization and ejects ink of each color onto the printing medium, thereby performing printing. In the present embodiment, the output unit 1345 is configured by a printing mechanism including the printing head 104 illustrated in FIG. 1.

Further, in the image processing unit 134, a second intermediate image for the ink image, which includes an independent ink image and corresponds to an auxiliary liquid application region, is formed depending on a shape and an area of the independent ink image, the kind of paper, a use history of the transfer body and the like. However, application of the present invention is not limited thereto. For example, it does not matter whether the second intermediate image determining the auxiliary liquid application region and application amount is formed by the image processing unit 134 or the upper device HC2.

The buffer 136 is, for example, a RAM, a hard disk or an SSD. The communication I/F 135 performs communications with the upper device HC2 and the communication I/F 137 performs communications with the engine controller 13B. In FIG. 2, a dashed line arrow indicates an example of an image data processing flow. The image data received from the upper device HC2 via the communication I/F 135 is accumulated in the buffer 136. The image processing unit 134 reads the image data from the buffer 136 and performs predetermined image processing on the read image data, and stores the image data in the buffer 136 again. The image data after image processing stored in the buffer 136 is transmitted from the communication I/F 137 to the engine controller 13B as a printing data used in a print engine.

As illustrated in FIG. 3, the engine controller 13B includes control units 14 and 15A to 15E, acquires sensing results of a sensor group and an actuator group 16 provided in the printing system 1, and performs driving control. Each of the control units includes a processor such as a CPU, a memory device such as a RAM or a ROM and an interface with an external device. Further, division of the control units is an example, and a part of the control may be performed by a plurality of control units that are further subdivided. On the contrary, a plurality of control units may be integrated and configured so that control operations thereof are performed in a single control unit.

An engine control unit 14 controls the entire engine controller 13B. A printing control unit 15A converts the printing data received from the main controller 13A into a data format suitable for driving a printing head 30 such as raster data. The printing control unit 15A controls ejection of each printing head 30.

A transfer control unit 15B controls the ink applying device 104, the liquid absorbing device 105, the heating unit 11 and the transfer body cleaning member 109.

A reliability control unit 15C controls the ink applying device 104 and controls, although not illustrated, a driving mechanism moving a recovery unit of the ink applying device between an ejection position and a recovery position.

A conveyance control unit 15D controls driving of the transfer body 101 or the printing medium conveyance device 107. An inspection control unit 15E controls, although not limited, an inspection unit.

A sensor sensing a position or a speed of a moving part, a sensor sensing a temperature, an image pickup element and the like are included in the sensor group among the sensor group and the actuator group 16. A motor, an electromagnetic solenoid, an electromagnetic valve and the like are included in the actuator group.

EXAMPLE

Hereinafter, the present exemplary embodiment is described in more detail through Examples and Comparative Examples. The present invention is not limited by the following Examples without departing from the gist of the present invention. Further, in the description of the following Examples, unless otherwise specified, the terms "part" and "%" are based on mass.

Example 1

<Preparation of Reaction Liquid>

A reaction liquid was prepared by mixing and sufficiently stirring the following components and performing pressure-filtration thereon using a cellulose acetate filter (manufactured by Advantech Co., Ltd.) having a pore size of 3.0 μm.

Levulinic acid: 40.0 parts
Glycerin: 5.0 parts
Megaface F444 (trade name, surfactant, manufactured by DIC Corp.): 1.0 parts
Ion-exchange water: 54.0 parts <Preparation of Resin Particle>

A 4-neck flask equipped with a stirrer, a reflux condenser and a nitrogen gas introducing tube was charged with 18.0 parts of butyl methacrylate, 2.0 parts of a polymerization initiator (2,2'-azobis(2-methylbutyronitrile)) and 2.0 parts of n-hexadecane, and a nitrogen gas was introduced into a reaction system, followed by stirring for 0.5 hours. After 78.0 parts of a 6.0% aqueous solution of an emulsifier (trade name: "NIKKOL BC15", manufactured by Nikko Chemicals Co., Ltd.) were dropped into the flask, the mixture were stirred for 0.5 hours. Then, the mixture was emulsified by being irradiated with ultrasonic waves for 3 hours using an ultrasonic irradiator. Thereafter, a polymerization reaction was carried out at 80° C. for 4 hours under a nitrogen atmosphere. After the reaction system was cooled to 25° C. and a component was filtered, and a suitable amount of pure water was added thereto, thereby preparing a water dispersion of a resin particle 1 in which a content (solid content) of the resin particle was 20.0%.

<Preparation of Aqueous Solution of Resin>

A styrene-ethyl acrylate-acrylic acid copolymer (resin 1) having an acid value of 150 mgKOH/g and a weight average molecular weight of 8,000 was prepared. An aqueous solution of the resin 1 in which a content (solid content) of the resin was 20.0% was prepared by neutralizing 20.0 parts of the resin 1 with potassium hydroxide in a molar amount equivalent to an acid value and adding a suitable amount of pure water thereto.

Further, the resin 1 was changed to a styrene-butyl acrylate-acrylic acid copolymer (resin 2) having an acid value of 132 mgKOH/g, a weight average molecular weight of 7,700 and a glass transition temperature of 78° C. An aqueous solution of the resin 2 in which a content (solid content) of the resin was 20.0% was prepared by the same procedure as in resin 1 except for the above-mentioned difference.

<Preparation of Ink>

(Preparation of Pigment Dispersion)

First, 10.0 parts of a pigment (carbon black), 15.0 parts of the aqueous solution of the resin 1 and 75.0 parts of pure water were mixed with each other. The mixture and 200 parts of zirconia beads having a diameter of 0.3 mm were placed in a batch type vertical sand mill (manufactured by AIMEX Co., Ltd.) and dispersed for 5 hours while cooling with water. Thereafter, coarse particles were removed by centrifugation, and the resultant was subjected to pressure-filtration with a cellulose acetate filter (manufactured by Advantech Co., Ltd.) having a pore size of 3.0 μm, thereby preparing a pigment dispersion K in which a content of the pigment was 10.0% and a content of a resin dispersant (resin 1) was 3.0%.

Ink was prepared by additionally mixing and sufficiently stirring the following components and performing pressure-filtration thereon using a cellulose acetate filter (manufactured by Advantech Co., Ltd.) having a pore size of 3.0 μm.

Pigment dispersion K: 20.0 parts
Water dispersion of resin particle 1: 50.0 parts
Aqueous solution of resin 1: 5.0 parts
Glycerin: 5.0 parts
Diethylene glycol: 7.0 parts
Surfactant: "Acetylenol E100" (trade name, manufactured by Kawaken Fine Chemicals Co., Ltd.): 0.5 parts
pure water: 12.5 parts <Preparation of Auxiliary Liquid 1>

An auxiliary liquid 1 was obtained by mixing and sufficiently stirring the following components and performing pressure-filtration thereon using a cellulose acetate filter (manufactured by Advantech Co., Ltd.) having a pore size of 3.0 μm.

Water dispersion of resin particle 1: 30.0 parts
Aqueous solution of resin 2: 3.0 parts
Glycerin: 5.0 parts
Diethylene glycol: 4.0 parts
"Acetylenol E100" (trade name, manufactured by Kawaken Fine Chemicals Co., Ltd.): 1.0 parts
Pure water: 57.0 parts <Preparation of Auxiliary Liquid 2>

(Preparation of Wax Particle Dispersion 1)

"Selosol 524" (manufactured by Chukyo Yushi Co., Ltd.) was diluted with ion-exchange water, thereby obtaining a wax particle dispersion 1 in which a non-volatile content was 25.0 mass %. A melting point of wax particles was 83° C. A volume average particle diameter of the wax particles was 70 nm.

The obtained resin particle dispersion and the wax dispersion were mixed with the following components, thereby obtaining an auxiliary liquid 2.

Wax particle dispersion 1: 20.0 parts

Aqueous solution of resin 2: 1.5 parts

Dispersion of resin particle 1: 20.0 parts

Glycerin: 7.0 parts

"Pluronic L31" (trade name, manufactured by Adeka Corp., surfactant): 3.0 parts

"Acetylenol E100" (trade name, manufactured by Kawaken Fine Chemicals Co., Ltd., surfactant): 0.5 parts Pure water: 48.0 parts <Manufacturing of Porous Body>

As a liquid absorbing member 105*a*, a laminate in which a nonwoven fabric "HOP" (manufactured by Hirose Paper Mfg Co., Ltd.) was laminated on a PTFE having an average pore size of 0.4 μm by heating was used. A Gurley value of this absorbing member 105*a* was 5 seconds.

<Ink Jet Printing Apparatus and Image Formation>

A transfer type ink jet printing apparatus illustrated in FIG. 1 was used. A transfer body 101 was fixed to a surface of a support member 102 using a double-sided tape. A sheet in which a PET sheet having a thickness of 0.5 mm was coated with silicone rubber (trade name: "KE12", manufactured by Shin-Etsu Chemical Co., Ltd.) at a thickness of 0.3 mm was used as an elastic layer of the transfer body 101. Further, a mixture of a condensate obtained by mixing glycidoxypropyltriethoxysilane and methyltriethoxysilane with each other at a molar ratio of 1:1 and heating and refluxing them and a photo-cation polymerization initiator (trade name: "SP150", manufactured by ADEKA Corp.) was prepared. Atmospheric plasma treatment was performed so that a contact angle between a surface of the elastic layer and water was 10 degrees or less. Thereafter, the mixture was applied onto the elastic layer and subjected to UV light irradiation (high pressure mercury lamp, integrated exposure amount: 5000 mJ/cm$^2$) and thermal curing (150° C., 2 hours) to form a film, thereby manufacturing a transfer body 101 in which a surface layer having a thickness of 0.5 μm was formed on the elastic layer. Then, a surface of the transfer body 101 was maintained at 60° C. by a heating unit (not illustrated).

An application amount of the reaction liquid applied by a reaction liquid applying device 103 was 0.5 g/m$^2$. In an ink applying device 104, a solid image was formed on the transfer body using an ink jet printing head ejecting ink in an on-demand manner using an electro-thermal conversion element. At the time of forming the image, the ink and the auxiliary liquid were printed at a droplet volume of 4 pL per dot.

A liquid absorbing member 105*a* had a porous body at a side thereof coming in contact with a first intermediate image. After the liquid absorbing member 105*a* was immersed in a wetting liquid composed of 95 parts of ethanol and 5 parts of water and permeated with the wetting liquid before use, the wetting liquid was replaced with water. A nip pressure between the transfer body 101 and the liquid absorbing member 105*a* was made to be 3 kg/cm$^2$ on average by applying a pressure with a pressing member 105*b*. In addition, the pressing member 105*b* had a diameter of 250 mm. Further, an aqueous liquid component absorbed in the porous body by a contact with the first intermediate image was at least partially removed from the porous body before the porous body came in contact with the first intermediate image again.

A conveyance speed of the liquid absorbing member 105*a* was adjusted by extending rollers 105*c*, 105*d* and 105*e* conveying the liquid absorbing member 105*a* while extending the liquid absorbing member 105*a* so as to be equal to a movement speed of the transfer body 101. Further, a printing medium 108 was conveyed by a printing medium supply roller 107*a* and a printing medium winding roller 107*b* so as to have a speed equal to the movement speed of the transfer body 101. A conveyance speed of the printing medium 108 was 0.15 m/s. A transfer pressure was 5 kgf/cm$^2$, and a temperature was adjusted so that a temperature of the image before transferring was 100° C.

Figure 4:
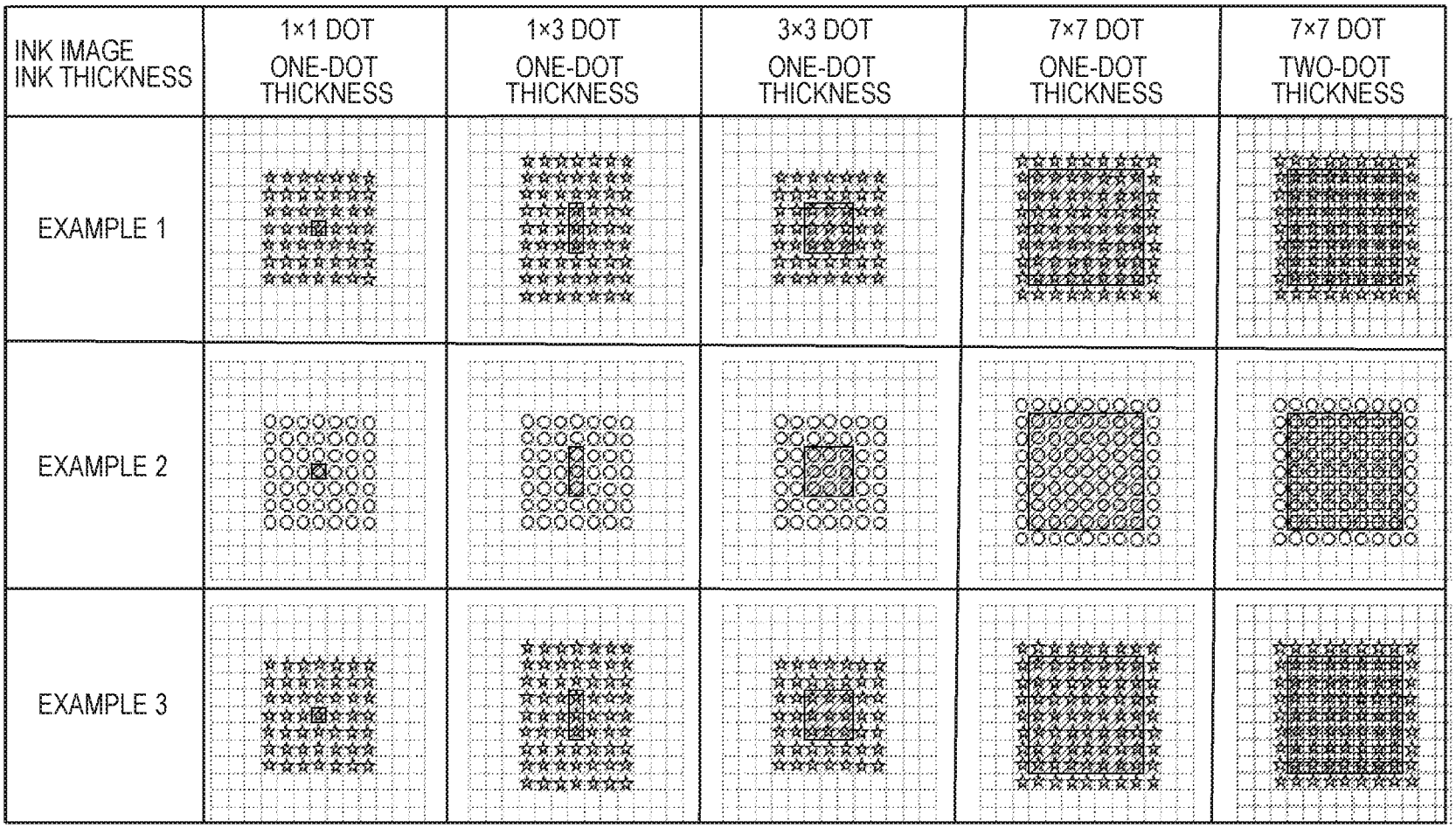
FIG. 4 is an image diagram for explaining an example of control of an auxiliary liquid application amount.

In forming the image according to the above-mentioned method, a shape of an independent ink image, the number of droplets of the ink, an auxiliary liquid application amount at a position corresponding thereto and the number of droplets of the applied auxiliary liquid are illustrated in FIG. 4.

Further, in respective cells illustrating patterns in FIGS. 4 to 7, a dashed line indicates a minimum unit in which the ink dot was disposed, and a hatched region enclosed by black lines indicates an ink application region.

Oblique hatching from an upper right portion to a lower left indicates a region to which one dot of ink was applied in a thickness direction (perpendicular to a drawing plane), and hatching for forming a lattice consisting of vertical and horizontal lines indicates a region to which two dots of ink was applied in the thickness direction (perpendicular to the drawing plane). A top row of each of the drawings in FIGS. 4 to 7 indicates an ink application region (an upper end) and a thickness (a lower end). That is, a "dot thickness" in the lower end indicates a dot thickness of the ink overlapped in the direction perpendicular to the drawing plane.

Further, an asterisk indicates a portion where two dots of the auxiliary liquid was applied in the thickness direction (perpendicular to the drawing plane), and a circle indicates a portion where one dot of the auxiliary liquid was applied in the thickness direction. In each of the Examples and the Comparative Examples in FIGS. 4 to 7, a region (13 mass×13 mass) illustrated in each cell was set as a minimum unit and was repeated in vertical and horizontal directions, thereby forming a test image (5 cm×5 cm). A test image was equally formed for five cells of the same row.

In present Example 1, areas of independent ink images were classified into three stages, and over-application amounts of the auxiliary liquid were controlled to three dots, two dots and one dot. Further, an application thickness of the auxiliary liquid was a two-dot thickness. As the auxiliary liquid, the auxiliary liquid 1 was used. As the printing medium, "OK prince high-quality paper" (manufactured by Oji Paper Co., Ltd.) was used.

Further, in the present Example, an auxiliary liquid application region was set to a wider region than an outer edge of the independent ink image in a plane direction.

[Evaluation]

The ink jet printing apparatus in each of the Examples and Comparative Examples was evaluated by the following evaluation method. Evaluation results are illustrated in Table 1. In the present Example, as the evaluation criteria in the following evaluation items, "A" and "B" were set as acceptable levels, and "C" was set as an unacceptable level.

<Transferability>

Transferability of the present apparatus in forming the image was evaluated. The printing medium after transferring the image was evaluated by the naked eyes. Evaluation criteria were as follows.

AA: Even though the image was continuously formed 100 times, five kinds of images had a sufficient density at all times.

A: Even though the image was continuously formed 100 times, almost all of the images had sufficient density. A density of the image at a few times was slightly low, but there was no problem.

B: Each of the images continuously formed 100 times had a slightly low density, but there was no problem as the images. The low density was ignorable.

C: An image that did not satisfy a desired density was included in the images continuously formed 100 times. The reason was estimated that transferring was not sufficiently performed and thus the image remained on the transfer body.

<Auxiliary Liquid Application Amount>

An auxiliary liquid application amount in forming the image was evaluated.

As the application amount, the numbers of dots in the patterns illustrated in FIGS. 4 to 7 were counted. The number of dots in a repeating unit (13 mass×13 mass) was a sum of the number of dots in 5 kinds of patterns.

Further, although a method of calculating an area of a rectangle was described in each of the Examples, but in the case of a figure including a curve, etc., depending on a length of a straight distance in a vertical direction in the figure, an over-application amount in the direction can be determined.

Example 2

Image formation and evaluation were performed in the same manner as in Example 1 except for decreasing a thickness of the auxiliary liquid using "Aurora coat paper" (trade name, manufactured by Nippon Paper Industries Co., Ltd.) having a smooth surface as a printing medium as illustrated in Example 2 of FIG. 4.

Example 3

Image formation by a control illustrated in FIG. 4 and evaluation were performed in the same manner as in Example 1 except for using the auxiliary liquid 2 instead of the auxiliary liquid 1.

Examples 4 and 5

Figure 5:
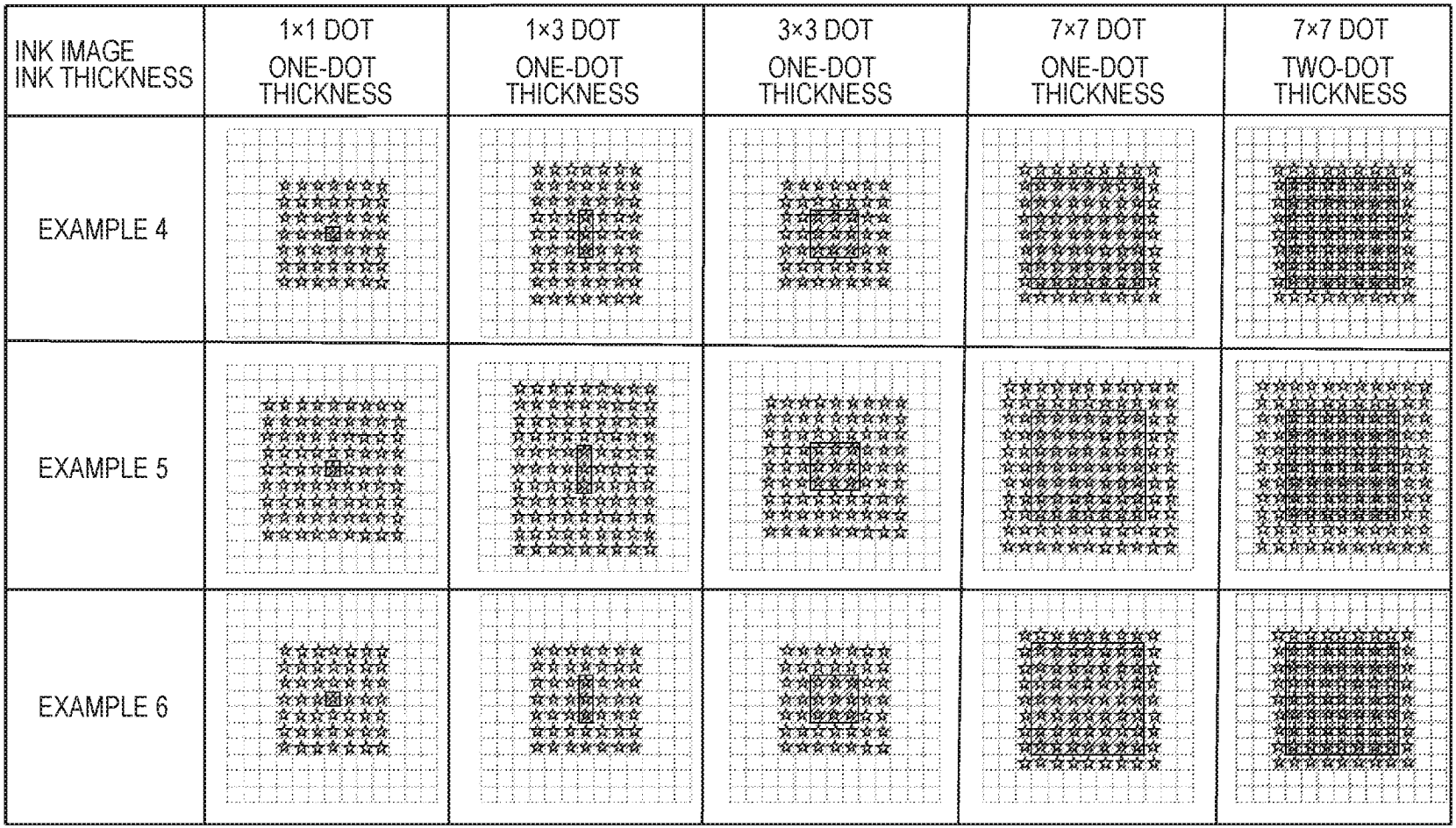
FIG. 5 is an image diagram for explaining an example of control of an auxiliary liquid application amount.

Image formation and evaluation were performed in the same manner as in Example 1 except for using a transfer body on which image formation was repeated 1000 times and the over-application amounts of the auxiliary liquids were changed as illustrated in FIG. 5 in the respective Examples.

Example 6

Image formation and evaluation were performed in the same manner as in Example 1 except for changing the over-application amount of the auxiliary liquid as illustrated in FIG. 5.

Example 7

Figure 6:
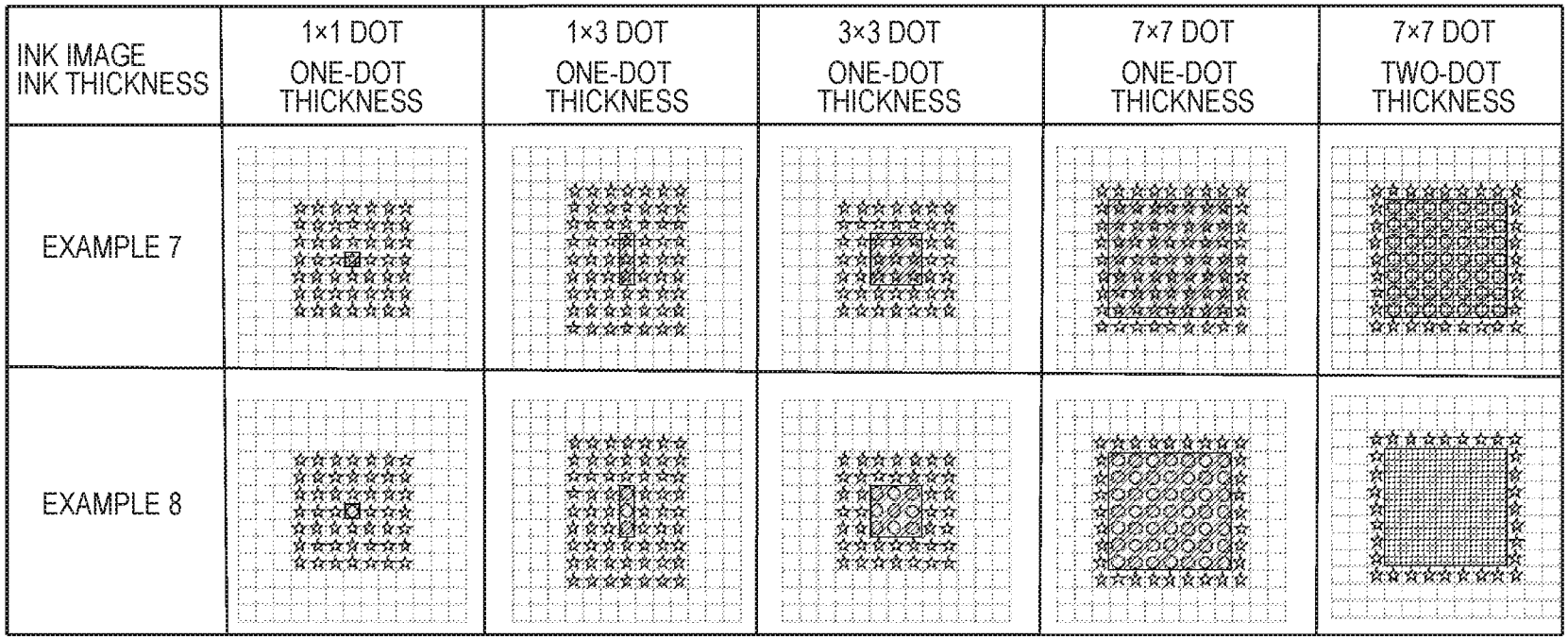
FIG. 6 is an image diagram for explaining an example of control of an auxiliary liquid application amount.

Image formation and evaluation were performed in the same manner as in Example 1 except for performing a thickness control of the auxiliary liquid depending on the thickness of the ink image as illustrated in FIG. 6.

Example 8

Image formation and evaluation were performed in the same manner as in Example 2 except that a pattern of the auxiliary liquid as illustrated in FIG. 6 was used and a thickness control was performed. Further, in the present Example 8 of FIG. 6, the auxiliary liquid was not applied to a central portion of a pattern corresponding to "7×7 dot and two-dot thickness".

Example 9

Figure 7:
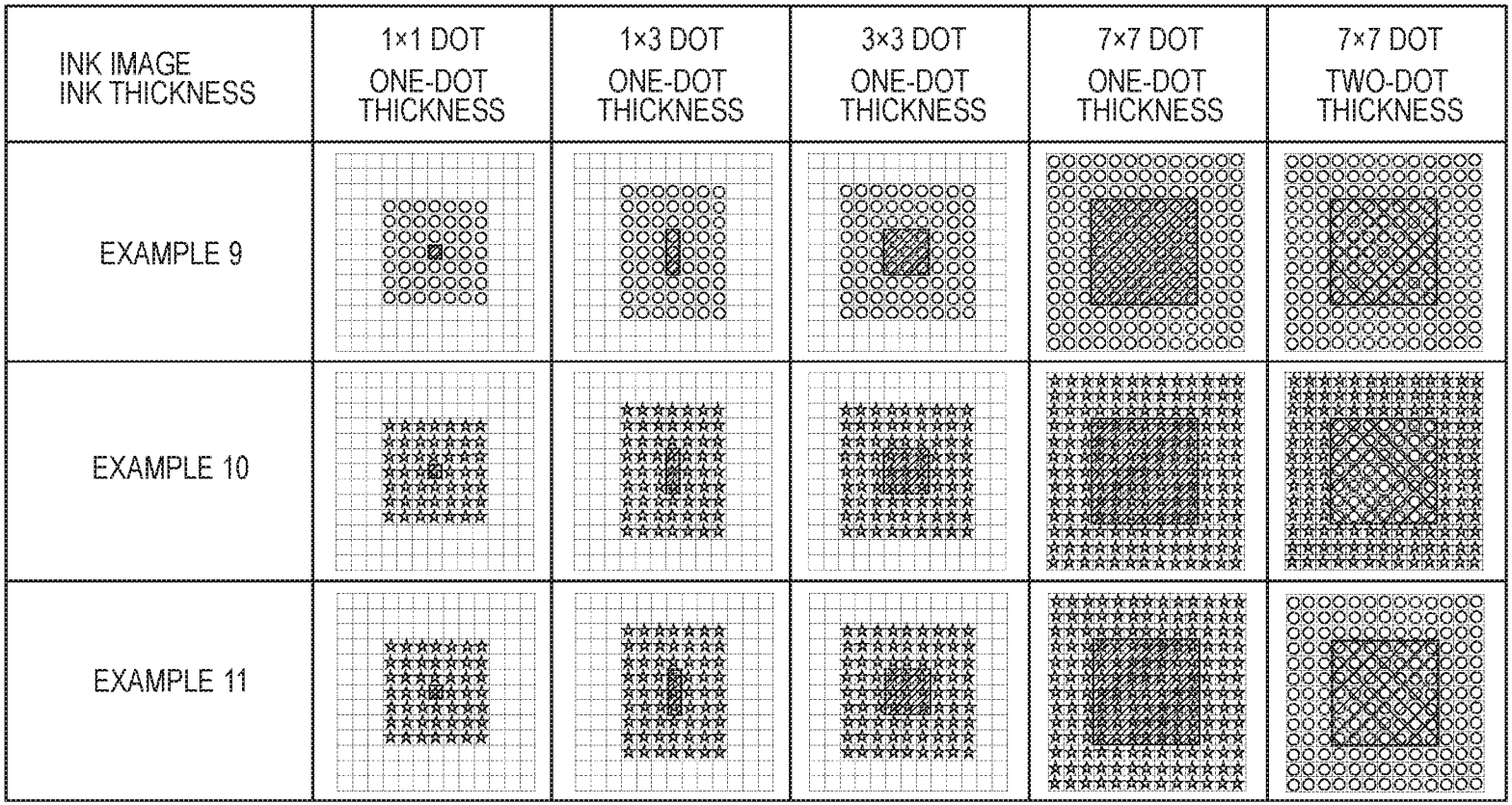
FIG. 7 is an image diagram for explaining an example of control of an auxiliary liquid application amount.

An image was formed using "aurora coat paper" similarly in Example 2 by applying the auxiliary liquid in a wider region around an ink dot than that in Example 2 in the cases of a "3×3 dot shape and one-dot thickness", a "7×7 dot shape and one-dot thickness", and a "7×7 dot shape and two-dot thickness" as illustrated in FIG. 7. Except for the above-mentioned difference, other contents were the same as in Example 2.

Example 10

An image was formed using "OK prince high-quality paper" as in Example 1. In the cases of a "1×1 dot shape and one-dot thickness", a "1×3 dot shape and one-dot thickness", a "3×3 dot shape and one-dot thickness", and a "7×7 dot shape and one-dot thickness" as illustrated in FIG. 7, thicknesses of the auxiliary liquid applied onto an ink dot and around the ink dot were increased as compared to Example 9. In the case of a "7×7 dot shape and two-dot thickness", the auxiliary liquid was applied so that a thickness of the auxiliary liquid applied around an ink dot was increased as compared to Example 9, and a thickness of the auxiliary liquid applied onto the ink dot was equal to that in Example 6. Except for the above-mentioned difference, other contents were the same as in Example 9.

Example 11

An image was formed using "OK prince high-quality paper" as in Example 1 while changing an application amount as compared to the case in which another ink dot has a one-dot thickness so as to decrease the thickness of the auxiliary liquid applied onto the ink dot in the case in which the ink dot has a two-dot thickness and additionally decrease the thickness of the auxiliary liquid applied around the ink dot as illustrated in FIG. 7. Except for the above-mentioned difference, other contents were the same as in Example 1. The image formed as described above was evaluated.

Comparative Example 1

Image formation and evaluation were performed in the same manner as in Example 1 except that an application area of the auxiliary liquid was not larger than that of the ink as illustrated in FIG. 7.

Comparative Example 2

In Comparative Example 2, image formation and evaluation were performed in the same manner as in Example 1 except that the auxiliary liquid was applied onto an entire printing range as illustrated in FIG. 7.

TABLE 1

| | Transfer-ability | Auxiliary Liquid Application Amount |
|---|---|---|
| Example 1 | A | 646 |
| Example 2 | A | 323 |
| Example 3 | AA | 646 |
| Example 4 | B | 646 |
| Example 5 | A | 1006 |
| Example 6 | A | 618 |
| Example 7 | A | 597 |
| Example 8 | A | 486 |
| Example 9 | A | 435 |
| Example 10 | A | 821 |
| Example 11 | A | 749 |
| Comparative Example 1 | C | 222 |
| Comparative Example 2 | A | 1440 |

Figure 8:
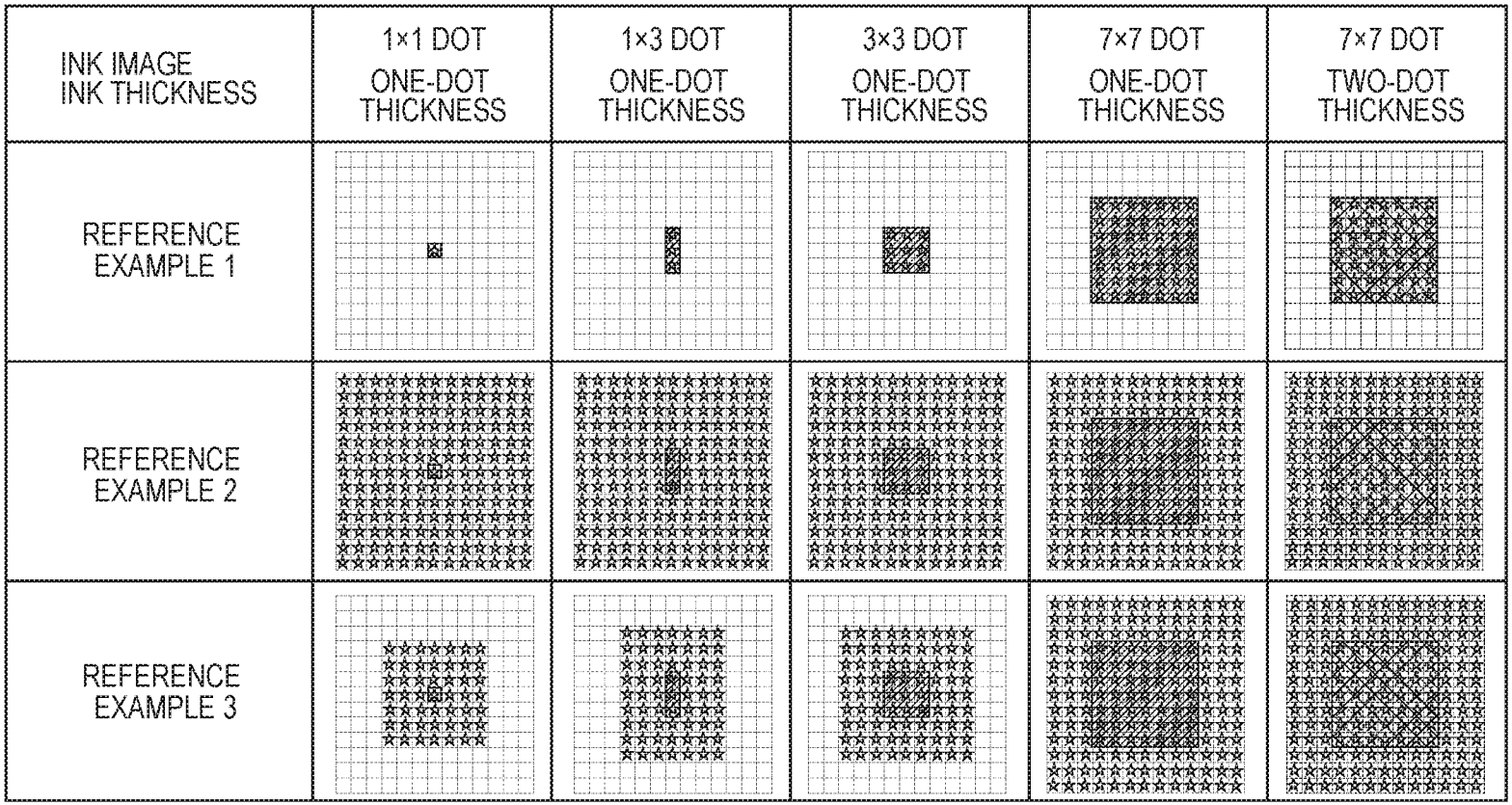
FIG. 8 is an image diagram for explaining an example of control of an auxiliary liquid application amount.

Further, as Reference Example, image formation and evaluation were performed using "Aurora coat paper" by adjusting application of the auxiliary liquid depending on the ink image and thickness as illustrated in FIG. 8. Transferability was evaluated as "A", but an auxiliary liquid application amount was 870.

Comparing Examples 1 and 2, it can be appreciated that an amount of the auxiliary liquid can be controlled to be small by considering properties of the used printing medium. Further, comparing Examples 4 and 5, it can be appreciated that transferability was improved by increasing an area difference between the ink application region and the auxiliary liquid application region. It could be appreciated that since in Example 6, transferability of the pattern corresponding to 1×3 dot and one-dot thickness was sufficient, the over-application amount of the auxiliary liquid can be suppressed to a small amount in a direction in which connection of the ink dots was large. In Example 7, a pattern at a leftmost end portion in FIG. 6 was transferred without problems even in the pattern in which one dot of the auxiliary liquid was applied on the ink image. Further, in Example 10, in a region in which the ink application amount was large, excellent transferability was obtained even in the case of decreasing the auxiliary liquid application amount. As described above, in the region in which the ink application amount was large, it is possible to decrease an amount of the auxiliary liquid. In addition, from a result in Example 11, it can be appreciated that a region adjacent to a region in which the ink application amount is large, it is possible to perform transferring while additionally suppressing the amount of auxiliary liquid by decreasing an over-application amount of the auxiliary liquid. Further, considering results in Examples 8 and 9, it can be appreciated that considering the kind of printing medium, even in a region in which the ink application amount is small, it is possible to perform transferring with a small amount of auxiliary liquid.

According to the exemplary embodiment described above, the ink jet printing method and the ink jet printing apparatus capable of simultaneously suppressing a transfer failure and a running cost can be provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-139516, filed Jul. 18, 2017, which is hereby incorporated by reference herein in its entirety.

What is claimed is:

1. An ink jet printing method comprising:

an image forming process of applying ink onto an image forming surface of a transfer body to form a first intermediate image;

an auxiliary liquid applying process of applying an auxiliary liquid comprising a thermoplastic resin onto the first intermediate image on the transfer body to form a second intermediate image, wherein the auxiliary liquid is applied to an auxiliary liquid application region on the transfer body, the auxiliary liquid application region being a predetermined region including the first intermediate image on the image forming surface and being wider than the first intermediate image on the image forming surface; and a transferring process of contacting the second intermediate image on the transfer body with a printing medium and separating the second intermediate image from the transfer body while maintaining a contact state with the printing medium to transfer the second intermediate image to the printing medium, wherein the auxiliary liquid applying process includes performing a control of an auxiliary liquid application area so that a difference of area along the image forming surface between an area of the first intermediate image and an area of the auxiliary liquid application region on the image forming surface, in the case in which an area of the first intermediate image is a first area, is larger than a difference of area along the image forming surface between an area of the first intermediate image and an area of the auxiliary liquid application region on the image forming surface, in the case in which the area of the first intermediate image is a second area that is larger than the first area.

2. The ink jet printing method according to claim 1, wherein the control of the auxiliary liquid application area includes a control of the auxiliary liquid application area depending on the kind of printing medium as well as a difference of area along the image forming surface between an area of the first intermediate image and an area of the auxiliary liquid application region on the image forming surface.

3. The ink jet printing method according to claim 1, wherein the auxiliary liquid application region is a region enclosed by an outer edge extending from an entire outer edge of the first intermediate image to the outside of the first intermediate image on the image forming surface.

4. The ink jet printing method according to claim 1, wherein an auxiliary liquid application amount per area of the image forming surface changes depending on the kind of printing medium.

5. The ink jet printing method according to claim 1, wherein the auxiliary liquid comprises wax particles, and the ink jet printing method further comprises a heating process of heating the transfer body to a temperature equal to or greater than a melting point of the wax particles.

6. An ink jet printing method comprising:

an image forming process of applying ink onto an image forming surface of a transfer body to form a first intermediate image;

an auxiliary liquid applying process of applying an auxiliary liquid comprising a thermoplastic resin onto the first intermediate image on the transfer body to form a second intermediate image, wherein the auxiliary liquid is applied to an auxiliary liquid application region on the transfer body, the auxiliary liquid application region being a predetermined region including the first intermediate image on the image forming surface and being wider than the first intermediate image on the image forming surface; and a transferring process of contacting the second intermediate image on the transfer body with a printing medium and separating the second intermediate image from the transfer body while maintaining a contact state with the printing medium to transfer the second intermediate image to the printing medium, wherein the auxiliary liquid applying process includes performing a control of an auxiliary liquid application area so that a difference of area along the image forming surface between an area of the first intermediate image and an area of the auxiliary liquid application region on the image forming surface is different depending on the kind of printing medium.

7. An ink jet printing apparatus comprising:

an image forming unit including an ink applying device applying ink onto an image forming surface of a transfer body to form a first intermediate image;

an auxiliary liquid applying device applying an auxiliary liquid comprising a thermoplastic resin onto the first intermediate image on the transfer body to form a second intermediate image, so as to apply the auxiliary liquid onto a set auxiliary liquid application region that includes the first intermediate image on the image forming surface and is wider than the first intermediate image on the image forming surface;

a transfer unit contacting the second intermediate image on the transfer body with a printing medium and separating the second intermediate image from the transfer body while maintaining a contact state with the printing medium to transfer the second intermediate image to the printing medium; and a control unit configured to set the auxiliary liquid application region so that a difference of area along the image forming surface between an area of the first intermediate image and an area of the auxiliary liquid application region on the image forming surface, in the case in which an area of the first intermediate image is a first area, is larger than a difference of area along the image forming surface between an area of the first intermediate image and an area of the auxiliary liquid application region on the image forming surface, in the case in which the area of the first intermediate image is a second area that is larger than the first area.

8. The ink jet printing apparatus according to claim 7, wherein control of the auxiliary liquid application region includes a control of the auxiliary liquid application region depending on the kind of printing medium as well a difference of area along the image forming surface between an area of the first intermediate image and an area of the auxiliary liquid application region on the image forming surface.

9. The ink jet printing apparatus according to claim 7, wherein the auxiliary liquid application region is a region enclosed by an outer edge extending from an entire outer edge of the first intermediate image to the outside of the first intermediate image on the image forming surface.

10. The ink jet printing apparatus according to claim 7, wherein an auxiliary liquid application amount per area of the image forming surface changes depending on the kind of printing medium.

11. The ink jet printing apparatus according to claim 7, wherein the auxiliary liquid comprises wax particles, and the ink jet printing apparatus further comprises a heating unit configured to heat the transfer body to a temperature equal to or greater than a melting point of the wax particles.

12. An ink jet printing apparatus comprising:

an image forming unit including an ink applying device applying ink onto an image forming surface of a transfer body to form a first intermediate image;

an auxiliary liquid applying device applying an auxiliary liquid comprising a thermoplastic resin onto the first intermediate image on the transfer body to form a second intermediate image, so as to apply the auxiliary liquid onto a set auxiliary liquid application region that includes the first intermediate image on the image forming surface and is wider than the first intermediate image on the image forming surface;

a transfer unit contacting the second intermediate image on the transfer body with a printing medium and separating the second intermediate image from the transfer body while maintaining a contact state with the printing medium to transfer the second intermediate image to the printing medium; and a control unit configured to set the auxiliary liquid application region on the image forming surface, so that a difference of area along the image forming surface between an area of the first intermediate image and an area of the auxiliary liquid application region on the image forming surface is different depending on the kind of printing medium.

13. An ink jet printing method comprising:

an image forming process of applying ink onto an image forming surface of a transfer body to form a first intermediate image;

an auxiliary liquid applying process of applying an auxiliary liquid comprising a thermoplastic resin onto the first intermediate image on the transfer body to form a second intermediate image; and a transferring process of contacting the second intermediate image on the transfer body with a printing medium and separating the second intermediate image from the transfer body while maintaining a contact state with the printing medium to transfer the second intermediate image to the printing medium, wherein the auxiliary liquid comprises wax particles, and the ink jet printing method further comprises a heating process of heating the transfer body to a temperature equal to or greater than a melting point of the wax particles, and wherein, in the auxiliary liquid applying process, an auxiliary liquid application amount when the printing medium is coated paper having a coating layer is smaller than an auxiliary liquid application amount per area of the image forming surface when the printing medium is not the coated paper.

14. The ink jet printing method according to claim 13, wherein a region including the first intermediate image on the image forming surface and being wider than the first intermediate image is set as an auxiliary liquid application region.

15. The ink jet printing method according to claim 14, wherein an auxiliary liquid application amount per area of a non-intermediate image region that is not an intermediate image region on the auxiliary liquid application region changes depending on an ink thickness of the first intermediate image formed in a region adjacent to the non-intermediate image region.

16. The ink jet printing method according to claim 13, wherein the auxiliary liquid application amount per area of the image forming surface changes depending on an ink thickness of the first intermediate image.

17. An ink jet printing apparatus comprising:

an image forming unit including an ink applying device applying ink onto an image forming surface of a transfer body to form a first intermediate image;

an auxiliary liquid applying device applying an auxiliary liquid comprising a thermoplastic resin onto the first intermediate image on the transfer body to form a second intermediate image; and a transfer unit contacting the second intermediate image on the transfer body with a printing medium and separating the second intermediate image from the transfer body while maintaining a contact state with the printing medium to transfer the second intermediate image to the printing medium, wherein the auxiliary liquid comprises wax particles, and the ink jet printing apparatus further comprises a heating unit configured to heat the transfer body to a temperature equal to or greater than a melting point of the wax particles, and wherein the ink jet printing apparatus further comprises an auxiliary liquid amount control unit configured to perform a control of an auxiliary liquid application amount so that an auxiliary liquid application amount when the printing medium is coated paper having a coating layer is smaller than an auxiliary liquid application amount per area of the image forming surface when the printing medium is not the coated paper.

18. The ink jet printing apparatus according to claim 17, wherein a region including the first intermediate image on the image forming surface and being wider than the first intermediate image is set as an auxiliary liquid application region, and the auxiliary liquid applying device applies the auxiliary liquid onto the auxiliary liquid application region.

19. The ink jet printing apparatus according to claim 18, wherein the auxiliary liquid amount control unit changes an auxiliary liquid application amount per area of a non-intermediate image region that is not an intermediate image region on the auxiliary liquid application region depending on an ink thickness of the first intermediate image formed in a region adjacent to the non-intermediate image region.

20. The ink jet printing apparatus according to claim 17, wherein the auxiliary liquid amount control unit changes the auxiliary liquid application amount per area of the image forming surface depending on an ink thickness of the first intermediate image.

* * * * *